US007793801B2

(12) United States Patent
Drummond

(10) Patent No.: US 7,793,801 B2
(45) Date of Patent: Sep. 14, 2010

(54) POSITIVE PRESSURE LIQUID TRANSFER AND REMOVAL SYSTEM CONFIGURED FOR OPERATION BY A HAND AND BY A FOOT

(76) Inventor: David Carl Drummond, 23 Lower Truro Road, Truro, NS (CA) B2N 5A9

( * ) Notice: Subject to any disclaimer, the term of this patent is extended or adjusted under 35 U.S.C. 154(b) by 2164 days.

(21) Appl. No.: 10/617,267

(22) Filed: Jul. 11, 2003

(65) Prior Publication Data

US 2009/0179049 A1 Jul. 16, 2009

Related U.S. Application Data

(63) Continuation-in-part of application No. 10/388,365, filed on Mar. 14, 2003, now abandoned.

(51) Int. Cl.
*B67D 7/06* (2010.01)

(52) U.S. Cl. ..... 222/179; 222/1; 222/209; 222/389; 222/401; 222/633; 141/392

(58) Field of Classification Search ..... 222/179, 222/207, 209, 213, 630–633, 389, 401, 190, 222/1; 251/294–295; 141/223–224, 392, 141/206

See application file for complete search history.

(56) References Cited

U.S. PATENT DOCUMENTS 505,642 A * 9/1893 Rowland ..... 222/209
2,628,744 A * 2/1953 Mowbray ..... 222/179
3,233,787 A * 2/1966 Ross ..... 222/179
3,823,752 A * 7/1974 Lasater et al. ..... 141/217
4,196,759 A * 4/1980 McMath et al. ..... 141/98
4,231,494 A * 11/1980 Greenwood ..... 222/325
4,593,729 A * 6/1986 Tamra ..... 141/218
4,668,187 A * 5/1987 Föster ..... 433/25
4,880,161 A * 11/1989 Wright ..... 239/330
5,664,702 A * 9/1997 Beauchamp ..... 222/179
5,897,031 A * 4/1999 Wirt et al. ..... 222/179

* cited by examiner

*Primary Examiner*—Frederick C. Nicolas
(74) *Attorney, Agent, or Firm*—Jones, Tullar & Cooper, P.C.

(57) ABSTRACT

A method of pumping liquid from a container to a destination comprises the steps of connecting a foot operable air pump in sealed air-delivery relation to the container; connecting a liquid delivery hose in sealed liquid receiving-relation to the container at the aperture such that the inlet end of the liquid delivery hose is submerged in liquid in the container, the liquid delivery hose having a hand operable valve for controlling the flow of the liquid through the liquid delivery hose; and operating the foot operable air pump by a foot, so as to pump air into the container, and operating the hand operable valve by a hand, so as to cause the liquid to flow from the container, through the liquid delivery hose, and to the destination. A related system, fitting, and adapter are also disclosed.

10 Claims, 22 Drawing Sheets

POSITIVE PRESSURE LIQUID TRANSFER AND REMOVAL SYSTEM CONFIGURED FOR OPERATION BY A HAND AND BY A FOOT

CROSS REFERENCE

This is a Continuation-In-Part Patent Application of U.S. patent application Ser. No. 10/388,365, filed Mar. 14, 2003 now abandoned.

FIELD OF THE INVENTION

The present invention relates to positive pressure liquid transfer and removal systems for pumping fluid, and related methods, and more particularly to such positive pressure liquid transfer and removal systems that use pressure for pumping liquids, as opposed to suction. Specifically, such a system that is configured for operation by a hand and by a foot, is disclosed.

BACKGROUND OF THE INVENTION

In many instances, it is necessary to pump a liquid, such as fuel, such as gasoline or diesel fuel or the like, water, and so on, from a first container, into a second container. The first container might be a transportable container such as a plastic or metal can used for transporting fuel, commonly called a "Jerry can", or similar. The second container might be a fuel tank on a vehicle, a snowmobile, a lawnmower, and so on, or might be another transportable container.

Where the liquid cannot be poured from the first container to the second container, for various reasons, such as safety, the process of transferring liquids is commonly performed by siphoning the liquid from the first container into the second container. It is well known to use one's mouth to start the siphoning process; however, this is often very undesirable, especially if a liquid such as a fuel is being siphoned. Accordingly, various types of pumps exist to make the process less undesirable, less dangerous, quicker, and so on.

In spite of the general availability of pumps (typically electrically operated) that might be suitable for pumping liquids from one container to another, it is uncommon for individuals to have readily available a pump that can be used in a situation such as filling a lawnmower fuel tank, filling a vehicle fuel tank (if the vehicle has run out of fuel), filling a boat fuel tank, and so on. It is much more common to merely pour the fuel from a container.

It is believed that part of the reason for this manner of transferring fuel is that there is a definite lack of ready-to-use, inexpensive pumping systems that are suitable for pumping liquids, especially fuel from a first container to a second container.

There are also other instances where pumping a liquid, such as fuel, is very difficult, and indeed, possibly even somewhat dangerous, due to the nature of the liquid. For instance, when removing fuel from a fuel tank in a vehicle, the only known way in the prior art to accomplish this is to siphon the fuel. The method of siphoning is a nuisance, and is even potentially dangerous when transferring fuel since it is common for a person to suck on the transfer hose in order to start the siphoning action. Further, the end container must be below the level of the fuel tank.

There are two-known prior art systems that are ready-to-use and may be suitable for transferring liquids, such as fuel, in some situations. Essentially, they are siphoning pumps that can be used to transfer liquid from a raised container to a container, tank, or the like, located at a lower elevation.

One such a siphoning pump is disclosed in U.S. Pat. No. 6,412,528 issued Jul. 2, 2002 to Alex et al. This manually operative siphoning pump comprises a pump mechanism disposed within a housing. The housing has an extended handle that leads to an inlet hose and also has a tubular outlet nozzle. A pump mechanism disposed within the housing comprises a cylindrical pump body disposed in fluid communication with the inlet hose and the tubular outlet nozzle. A cylindrical head mounted on an elongate cylindrical stem moves axially within the pump body to pump liquids from the inlet hose to the outlet hose disposed within the tubular outlet nozzle. The elongate cylindrical stem has a male retaining bulb seated within a female retaining bulb that is part of a bellows. A lever arm is pivotally mounted on the extended handle and engages the male retaining bulb to permit manual operation of the pump mechanism. The pump mechanism acts as a siphon to suction liquids from whatever source that the inlet hose is in fluid communication with.

There are at least three very distinct disadvantages to the siphoning pump apparatus disclosed in U.S. Pat. No. 6,412,528. Firstly, since this is a siphoning type of apparatus, the source of liquid must be located at an elevation above the pump and the destination container. This is extremely undesirable in situations where one might be filling a fuel tank on a vehicle and must hold a portable fuel can several feet in the air during the entire pumping operation, which might last several minutes. Further, there may be instances where the source of liquid is in a container, or the like, that cannot be elevated, such as if it is a permanent structure or is far too heavy to lift. In this case, the siphoning pump disclosed in the Alex et al patent would not work.

A second serious disadvantage relates to siphoning pressure limitations. Since the pump is only hand-operable by design, the maximum force that can be expected to be applied to the pumping mechanism is quite low. Accordingly, the pumping mechanism cannot be overly large and also has a limited maximum pumping throughout, that has been found to be lower than is desirable. Further, since the siphoning pump in the Alex et al patent necessitates hand operation, the duration that an individual can use this siphoning apparatus is generally quite limited.

An additional disadvantage relates to the amount of liquid flow realized during the pumping process. The amount of liquid flow is directly related to the pressure head of the volume of liquid being pumped. As the volume of liquid decreases during pumping so does the pressure head caused by the elevated volume of liquid. The rate of flow of the liquid being siphoned also decreases correspondingly. Accordingly, it can take a considerable amount of time to pump a volume of liquid.

Another such pumping system disclosed in U.S. Pat. No. 5,244,021 issued Sep. 14, 1993 to Hau. This fuel transfer container has a small hand operable squeeze bulb connected in fluid communication with the interior of the container. This squeeze bulb provides just enough pressure to start the siphoning action of the fuel in the container, through the inner dispensing conduit and out dispensing conduit, and then through the flexible delivery tube, when the lower end of the flexible delivery tube is located at a lower elevation than the liquid in the container.

It is not possible to actually pump liquid from within the container to an elevation above the container, which is highly undesirable. Accordingly, in instances where the destination of the liquid is at an elevation above the ground, the container must be raised above that elevation. One example of this would be transferring fuel from a fuel container into the fuel tank of a vehicle. It would be necessary to either set the container on the trunk of the vehicle, which is highly undesirable and also would require steadying of the container. However, it is necessary to use two hands in order to manipulate and operate this apparatus, which does not leave a free hand for steadying the container, which makes the procedure very difficult to perform safely. Further, in the event that the vehicle has no convenient surface, such as a trunk, to place the container on during use, the container would need to be held while transferring fuel. This is essentially not possible for one person to do, if they are also squeezing the squeeze bulb and holding the flexible delivery tube.

It is an object of the present invention to provide a positive pressure liquid transfer and removal system configured for operation by a hand and by a foot, for pumping liquids from one container to another.

It is an object of the present invention to provide a positive pressure liquid transfer and removal system configured for operation by a hand and by a foot, for pumping liquids from one container to another, wherein the pumping mechanism and the destination can be at the same elevation or at a higher elevation than the source.

It is another object of the present invention to provide a positive pressure liquid transfer and removal system configured for operation by a hand and by a foot, for pumping fuel from one container to another.

It is another object of the present invention to provide a positive pressure liquid transfer and removal system configured for operation by a hand and by a foot, for pumping fuel from a fuel tank in a vehicle to a destination.

It is an object of the present invention to provide a positive pressure liquid transfer and removal system configured for operation by a hand and by a foot, for pumping liquids from one container to another, that is inherently more safe than prior art systems where two hands are required.

SUMMARY OF THE INVENTION

In accordance with one aspect of the present invention there is disclosed a novel positive pressure liquid transfer and removal system configured for manual operation by a hand and by a foot, for pumping liquid from a container having an aperture, to a destination. The positive pressure liquid transfer and removal system comprises a foot operable pump means for pumping air into the container. A liquid delivery hose means for delivering liquid from the container to the destination has, in seriatim, a liquid intake section having a liquid inlet and being insertable into liquid in the container such that the liquid inlet is in liquid receiving relation with the container, a fitting for engaging the aperture of the container in sealed relation, and a liquid transport hose section having a liquid outlet end, with the liquid intake hose section and the liquid transport hose section in fluid communication one with the other. A hand operable valve means is operatively mounted on the liquid delivery hose means, for controlling the flow of the liquid through the liquid delivery hose means. There is means for connecting the foot operable pump means in sealed air-delivery relation to the container at the aperture, thereby permitting delivery of air from the foot operable pump means into the container through the aperture, so as to thereby effect a positive air pressure in the container. The positive air pressure in the container causes the liquid to flow from the container, through the liquid delivery hose means, and to the destination.

In accordance with another aspect of the present invention there is disclosed a novel positive pressure liquid transfer and removal system configured for manual operation by a hand and by a foot, for pumping liquid from a container having a first aperture and a second aperture, to a destination. The positive pressure liquid transfer and removal system comprises a foot operable pump means for pumping air into the container. A liquid delivery hose means for delivering liquid from the container to the destination has, in seriatim, a liquid intake section having a liquid inlet and being insertable into liquid in the container such that the liquid inlet is in liquid receiving relation with the container, a fitting for engaging the first aperture of the container in sealed relation, and a liquid transport hose section having a liquid outlet end, with the liquid intake hose section and the liquid transport hose section in fluid communication one with the other. A hand operable valve means is operatively mounted on the liquid delivery hose means, for controlling the flow of the liquid through the liquid delivery hose means. There is means for connecting the foot operable pump means in sealed air-delivery relation to the container at the second aperture, thereby permitting delivery of air from the foot operable pump means into the container through the second aperture, so as to thereby effect a positive air pressure in the container. The positive air pressure in the container causes the liquid to flow from the container, through the liquid delivery hose means, and to the destination.

In accordance with yet another aspect of the present invention there is disclosed a novel method of pumping liquid from a container to a destination. The method comprises the steps of connecting a foot operable air pump means in sealed air-delivery relation to the container; connecting a liquid delivery hose means in sealed liquid-receiving relation to the container at the aperture such that the inlet end of the liquid delivery hose means is submerged in liquid in the container, the liquid delivery hose means having a hand operable valve means for controlling the flow of the liquid through the liquid delivery hose means; and operating the foot operable air pump means by a foot, so as to pump air into the container, and operating the hand operable valve means by a hand, so as to cause the liquid to flow from the container, through the liquid delivery hose means, and to the destination.

In accordance with yet another aspect of the present invention there is disclosed a novel fitting for use in a positive pressure liquid transfer and removal system. The fitting comprises a main body having an annular flange shaped and dimensioned to engage in sealed relation the mouth of a conventional portable fuel container; an air inlet nozzle; a liquid receiving nozzle; and a liquid outlet nozzle.

In accordance with still another aspect of the present invention there is disclosed a novel fitting assembly for use in a positive pressure liquid transfer and removal system. The fitting comprises a lower fitting having a main body shaped and dimensioned to engage in sealed relation the mouth of a conventional portable fuel container, an air inlet nozzle and a liquid delivery hose opening; and an upper fitting having a main body shaped and dimensioned to engage in sealed relation the mouth of a conventional portable fuel container, an air supply hose opening and a liquid delivery hose opening.

In accordance with yet another aspect of the present invention there is disclosed a novel fitting for use in a positive pressure liquid transfer and removal system. The fitting comprises a main body having an annular flange shaped and dimensioned to engage in sealed relation the inlet of a conventional filler pipe of a vehicle, a tapered portion shaped and dimensioned to engage in sealed wedged relation into the inlet of a conventional filler pipe of a vehicle, a threaded inlet nozzle, and a throughpassage extending through the annular flange, the tapered portion, and the threaded inlet nozzle.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the positive pressure liquid transfer and removal system and method, configured for operation by a hand and by a foot, according to the present invention, as to its structure, organization, and use, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 14:
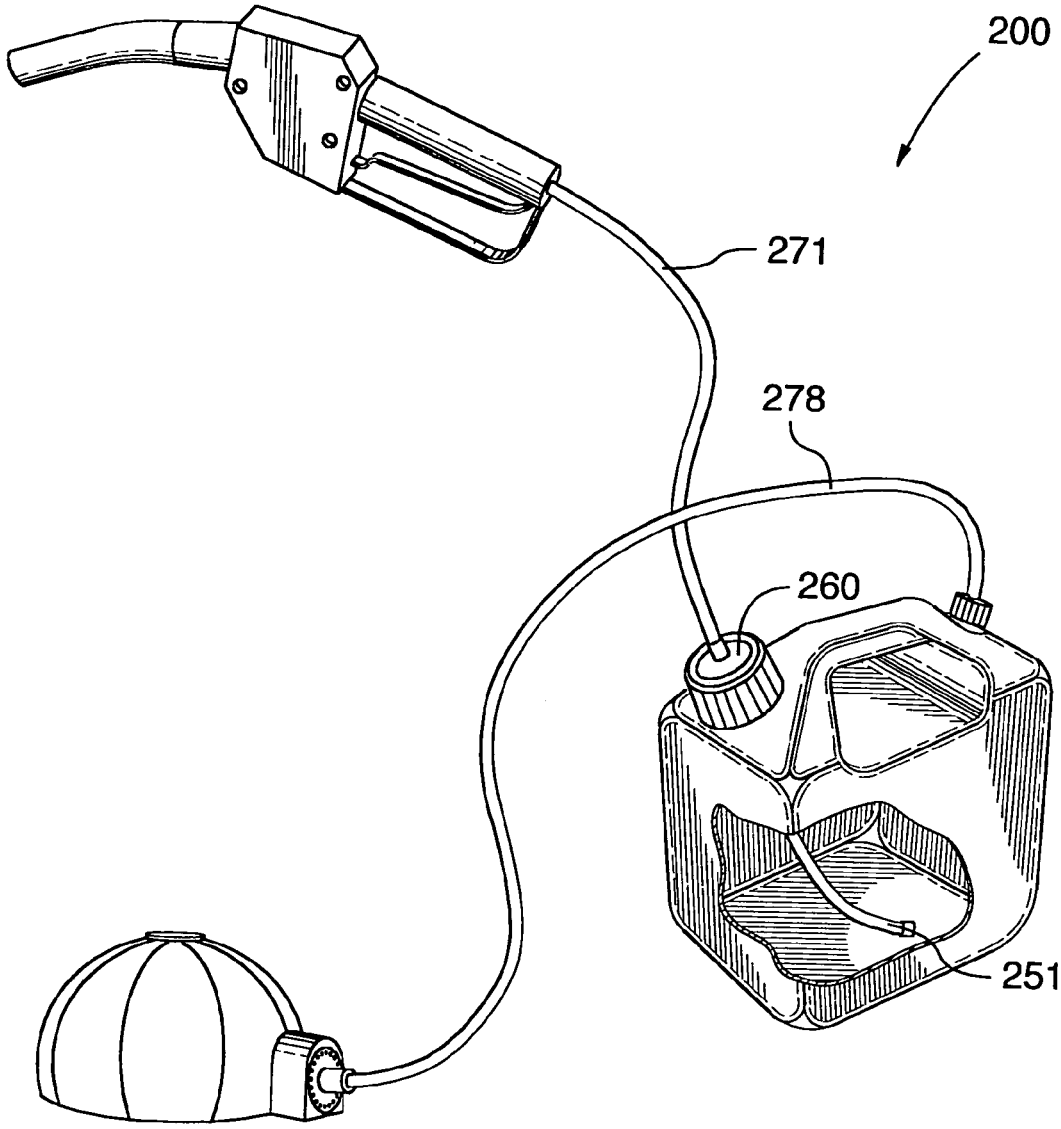
FIG. 14 is a perspective pictorial view of the second preferred embodiment of the positive pressure liquid transfer and removal system according to the present invention, showing the fitting in place in the mouth of a conventional portable fuel container.
Figure 15:
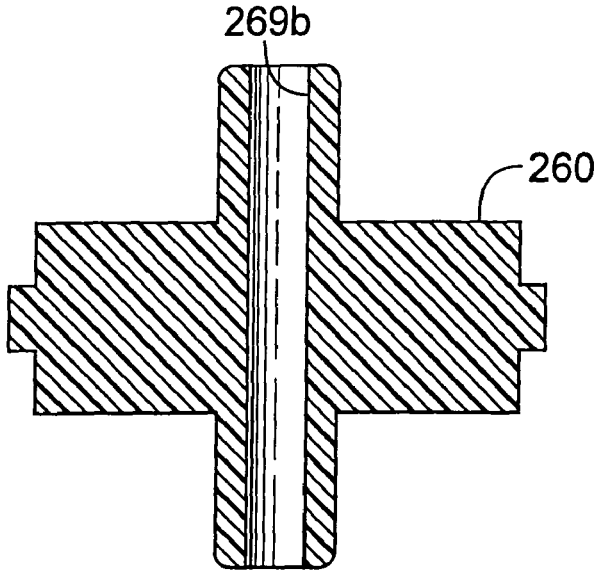
FIG. 15 is a sectional side elevational view of the fuel container fitting of FIG. 14, in place in a conventional portable fuel container, taken along section line 15-15.
Figure 16:
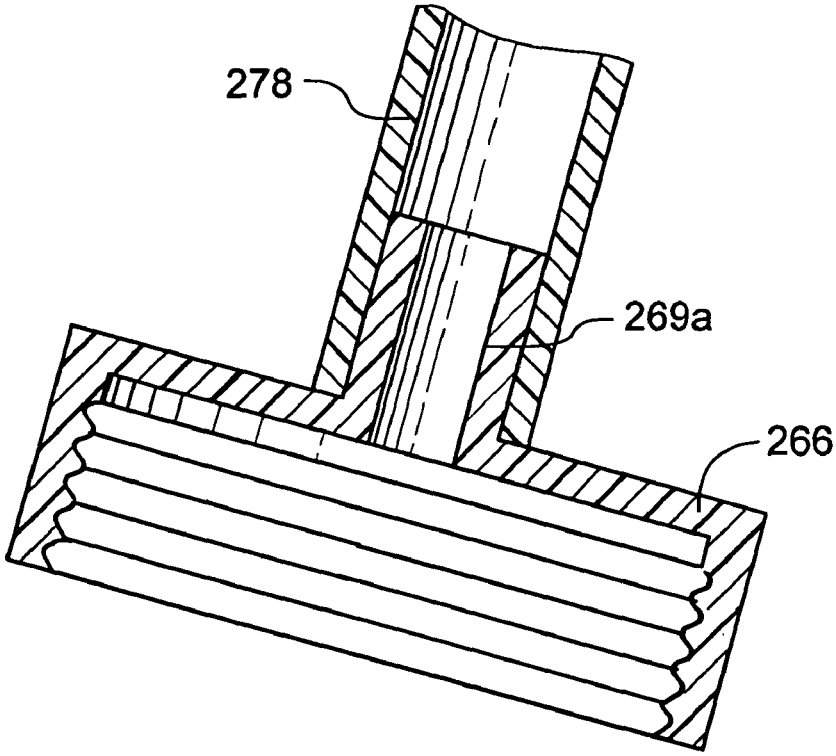
FIG. 16 is a sectional side elevational view of the secondary fuel container cap of FIG. 14, in place in a conventional portable fuel container, taken along section line 16-16.
Figure 17:
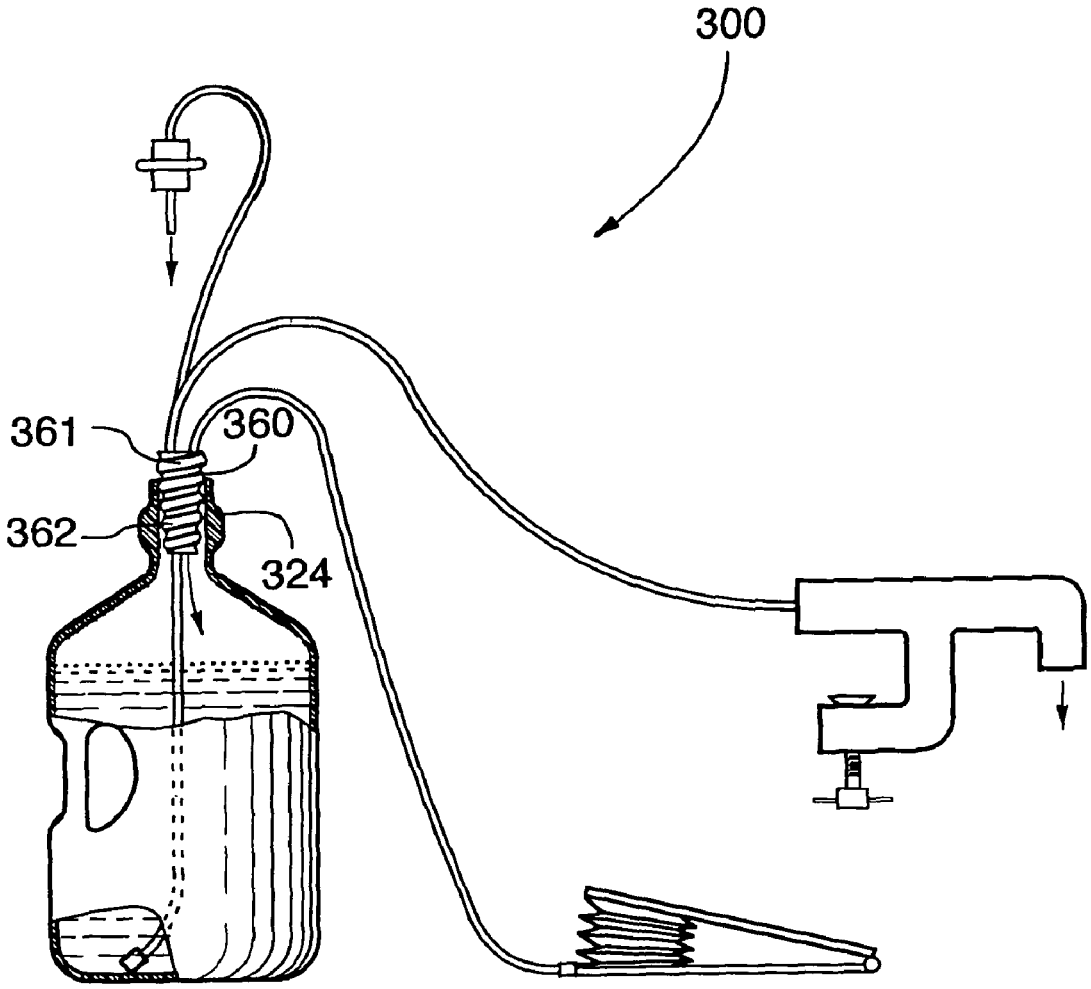
FIG. 17 is a side elevational view of the third preferred embodiment of the positive pressure liquid transfer and removal system according to the present invention, showing the fitting in place in the mouth of a conventional water bottle.
Figure 18:
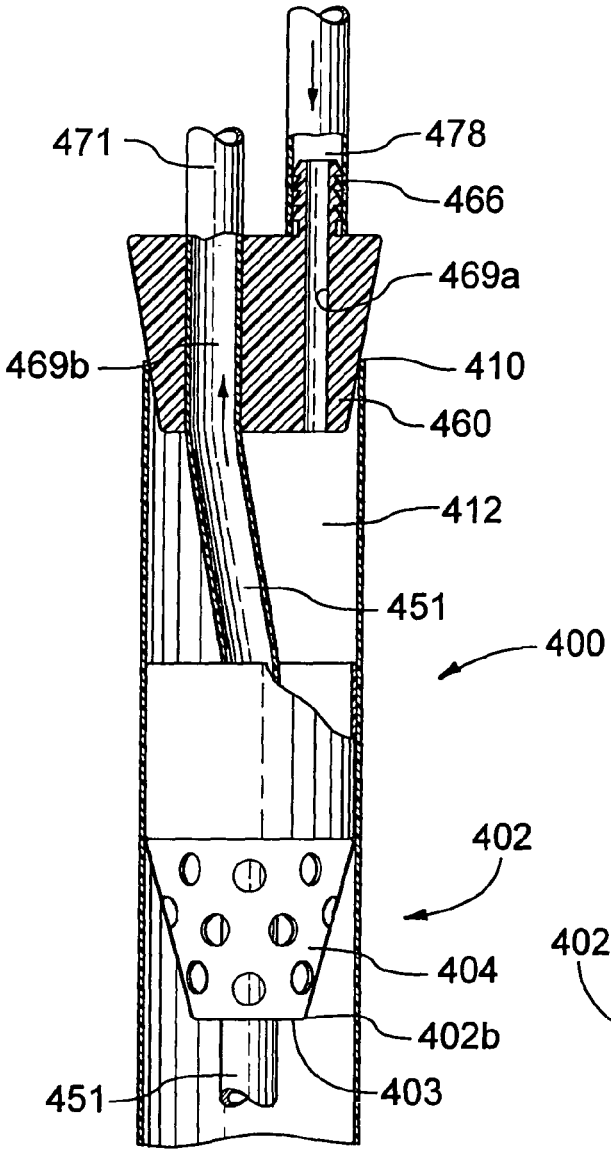
FIG. 18 is a cross-sectional view of the fourth preferred embodiment positive pressure liquid transfer and removal system, showing the fitting and the fitting adapter.
Figure 19:
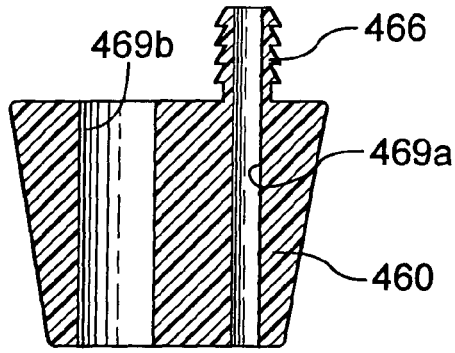
FIG. 19 is a cross-sectional view of the fitting shown in FIG. 18.
Figure 20:
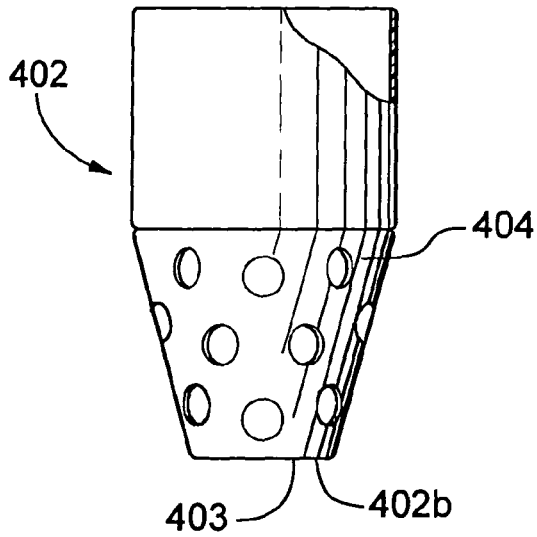
FIG. 20 is a cross-sectional view of the fitting adapter shown in FIG. 18.
Figure 21:
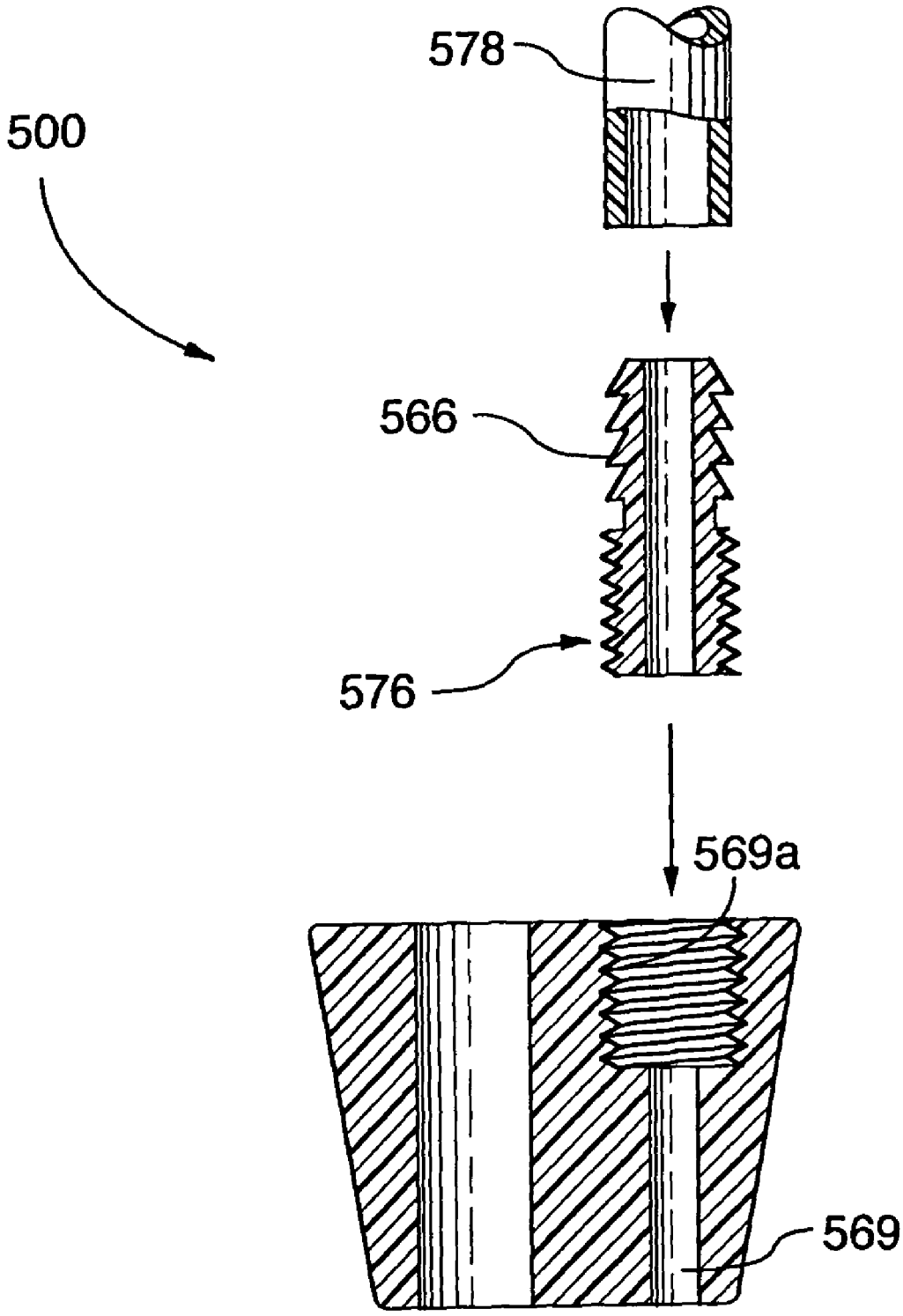
FIG. 21 is a side elevational view of the fitting of a fifth preferred embodiment of the positive pressure liquid transfer and removal system according to the present invention.
Figure 22:
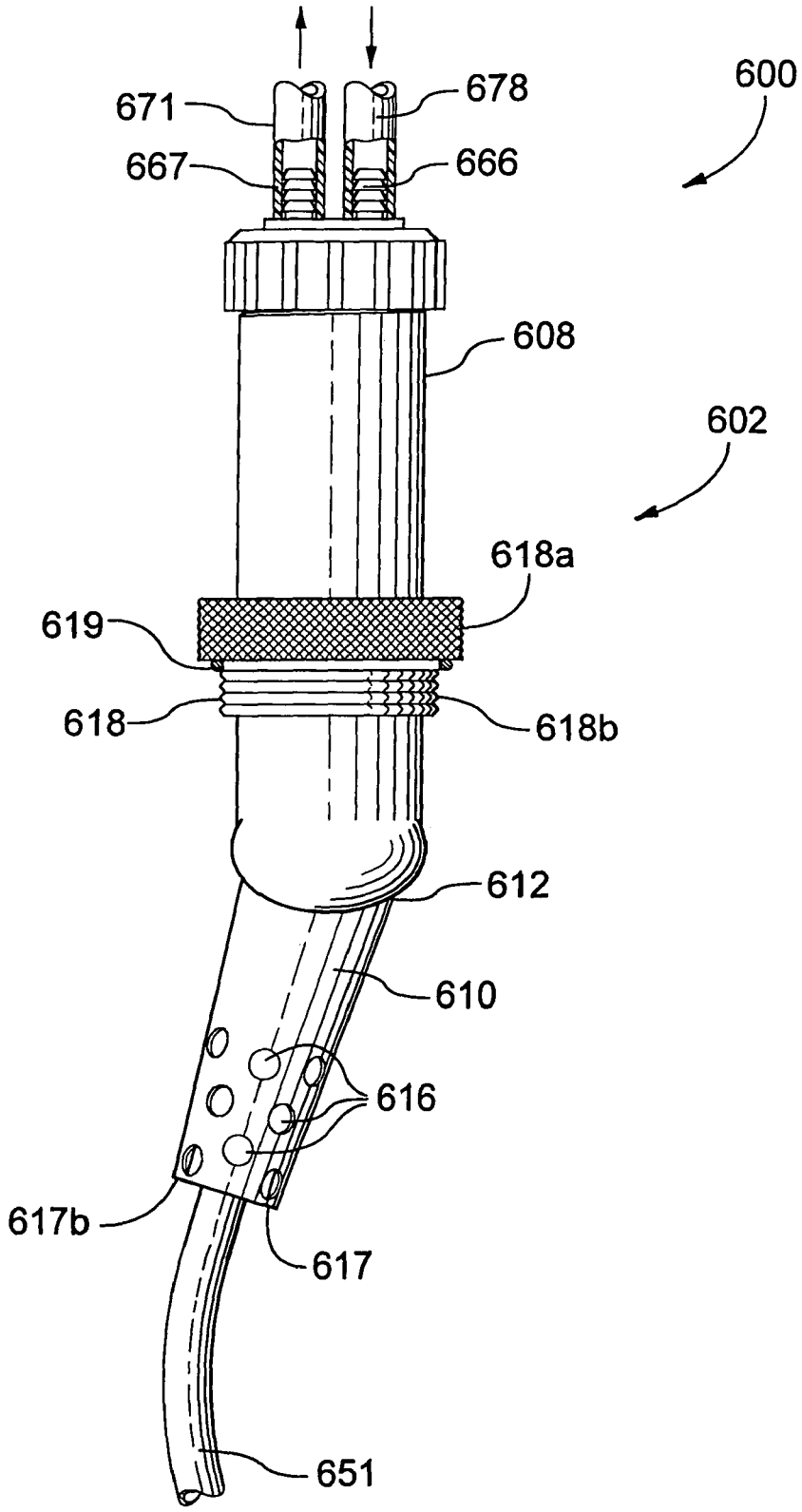
FIG. 22 is a side elevational view of a portion of the sixth preferred embodiment of the positive pressure liquid transfer and removal system according to the present invention, for installation onto the inlet of the filler pipe of a fuel tank of a vehicle.
Figure 23:
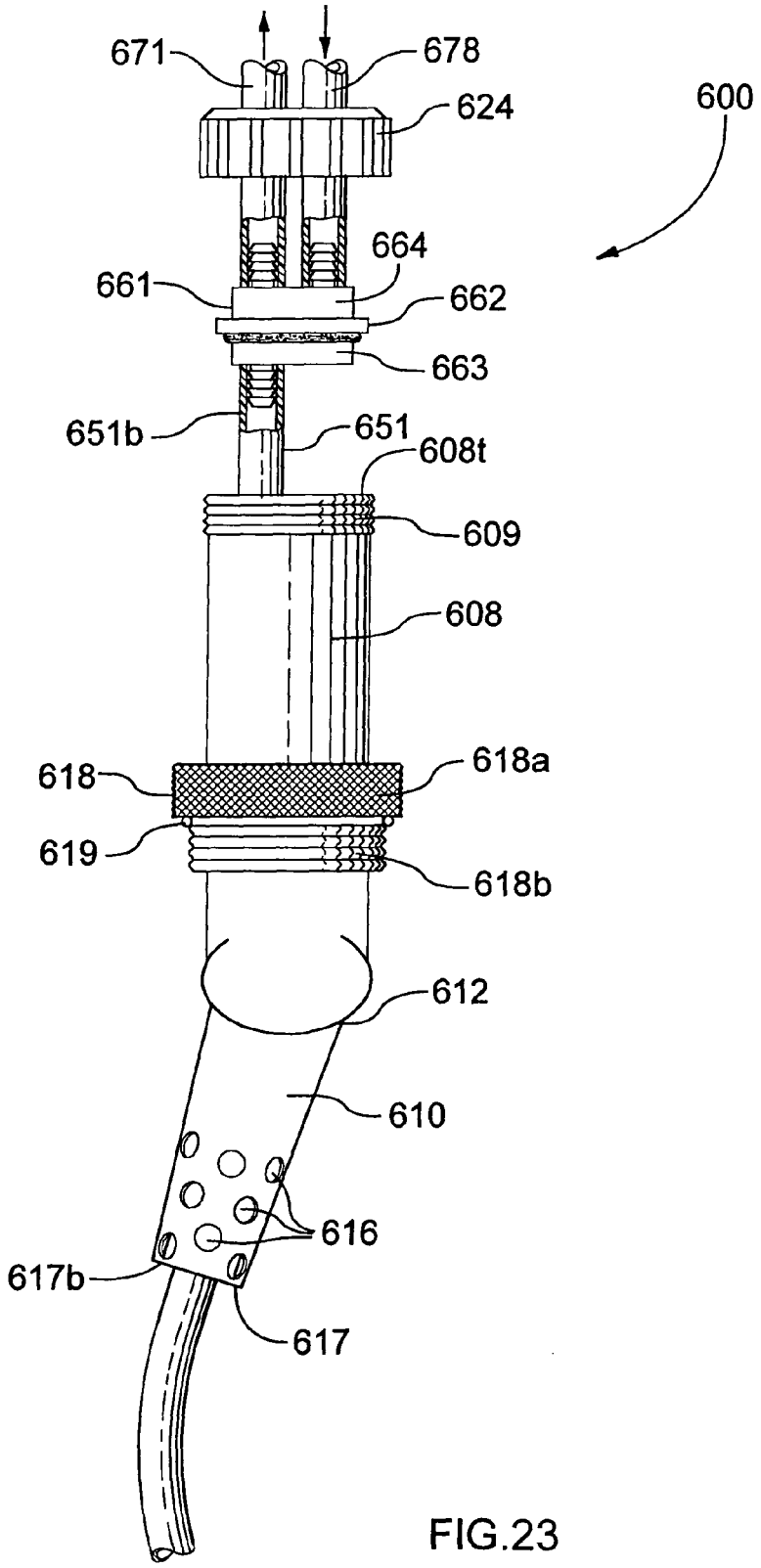
FIG. 23 is an exploded side elevational view of the positive pressure liquid transfer and removal system of FIG. 19.
Figure 27:
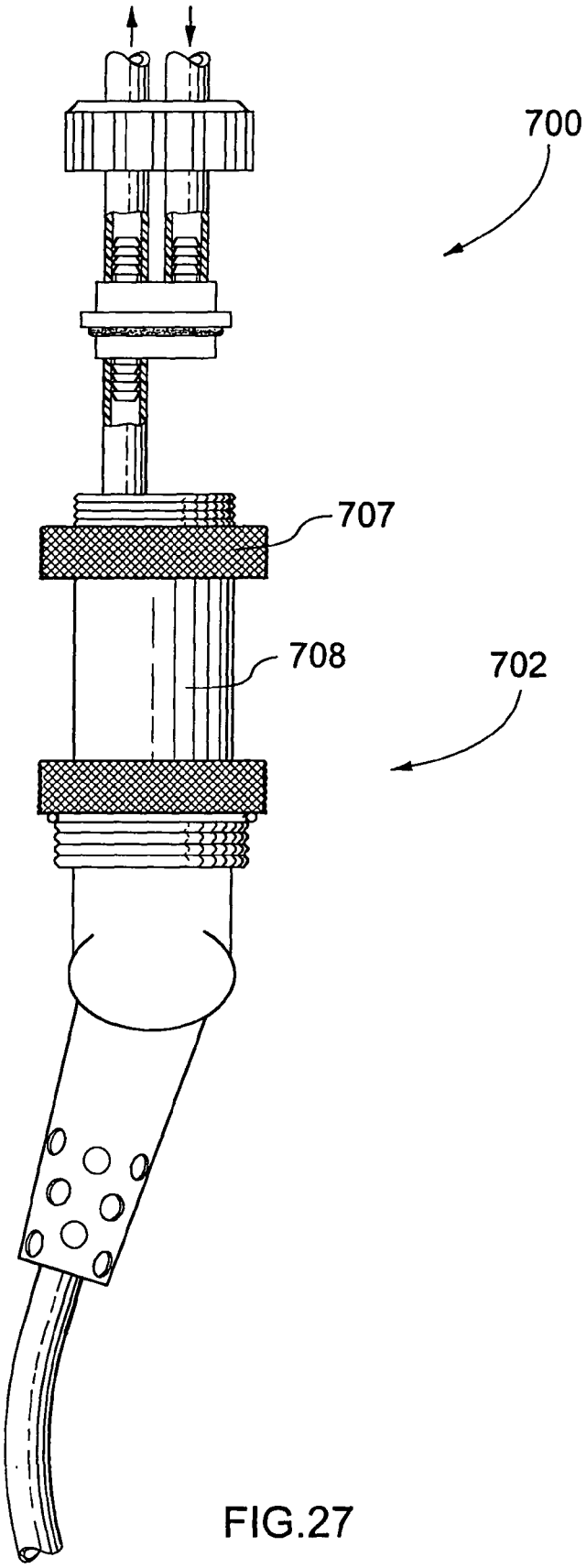
FIG. 27 is a exploded side elevational view of the seventh preferred embodiment of the positive pressure liquid transfer and removal system according to the present invention.
Figure 28:
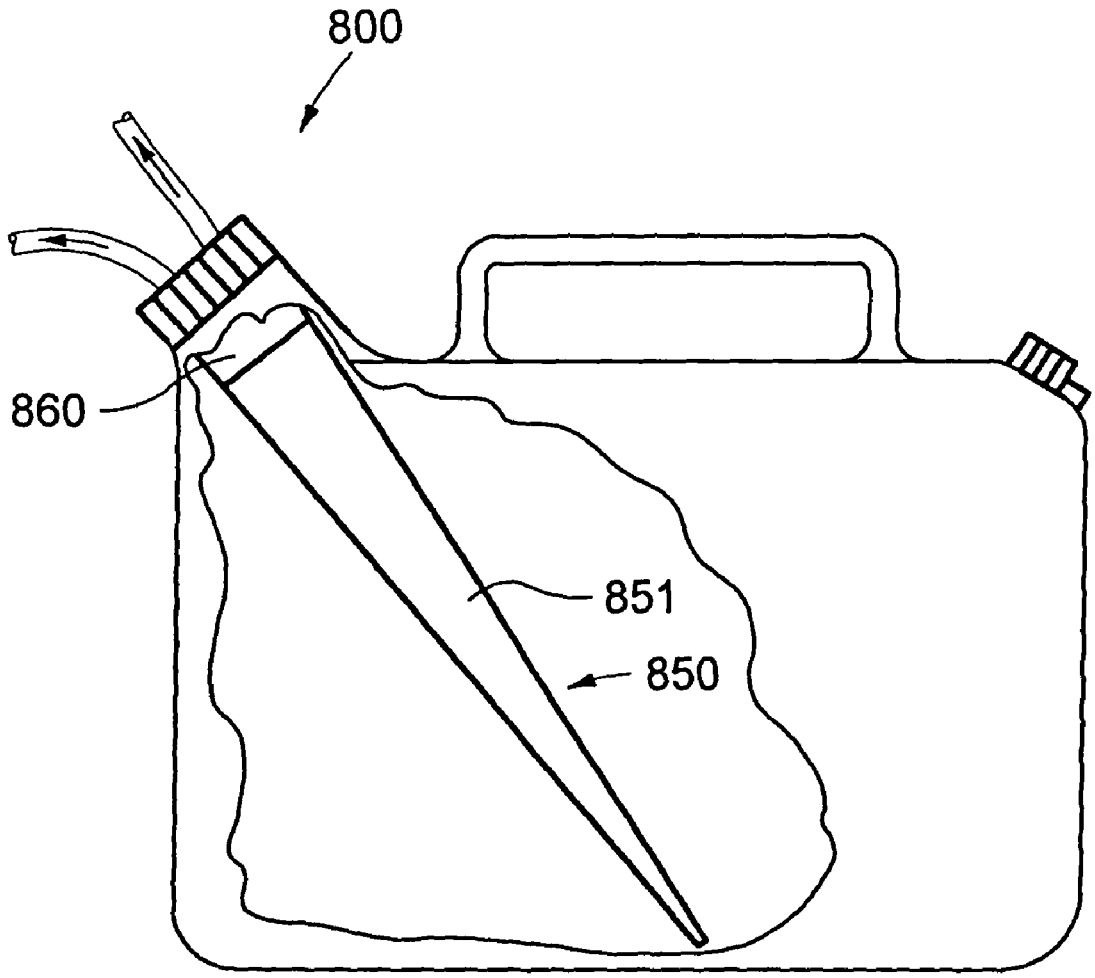
FIG. 28 is a side elevational view of the eighth preferred embodiment of the positive pressure liquid transfer and removal system according to the present invention, with the fitting inserted into the mouth of a conventional portable fuel container.
Figure 29:
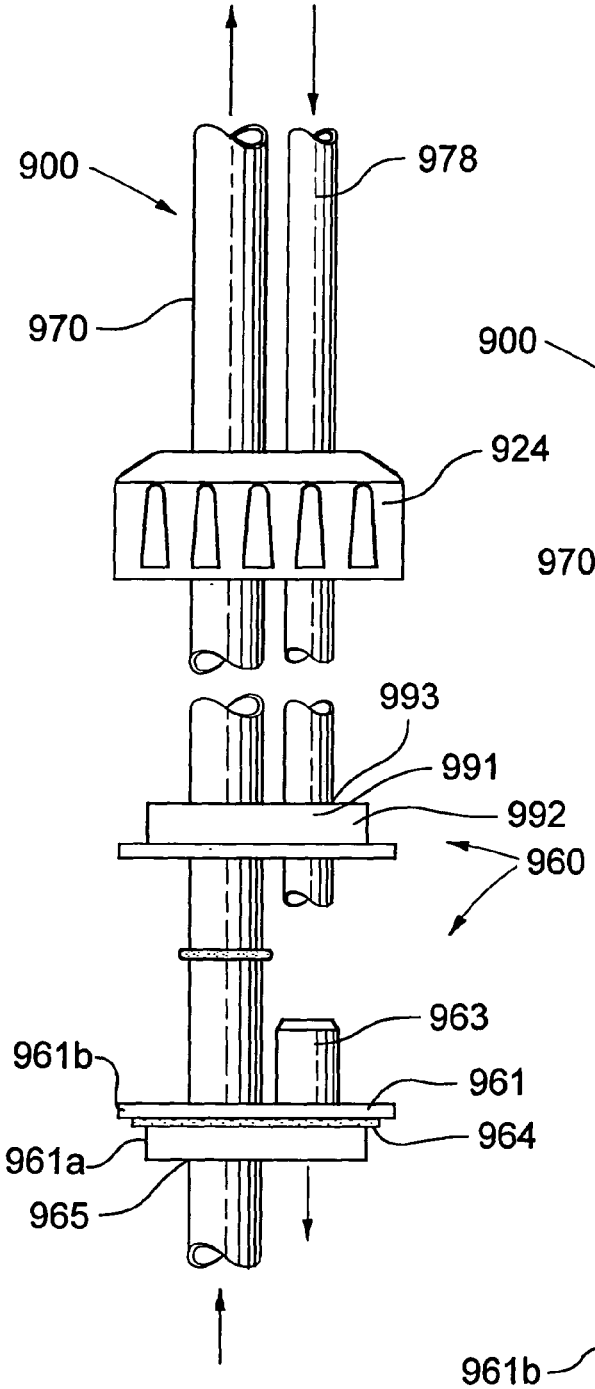
FIG. 29 is an exploded side elevational view of the ninth preferred embodiment of the positive pressure liquid transfer and removal system according to the present invention.
Figure 30:
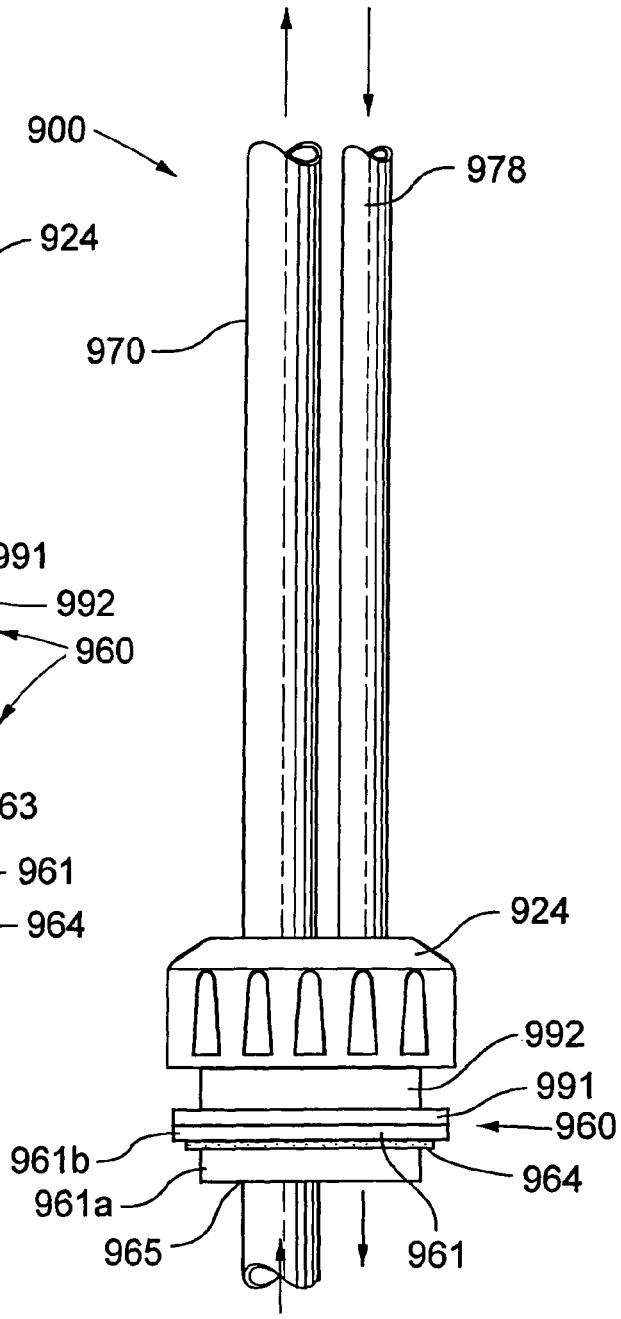
FIG. 30 is a side elevational view of the ninth preferred embodiment of the positive pressure liquid transfer and removal system of FIG. 29, but in an assembled configuration.
Figure 31:
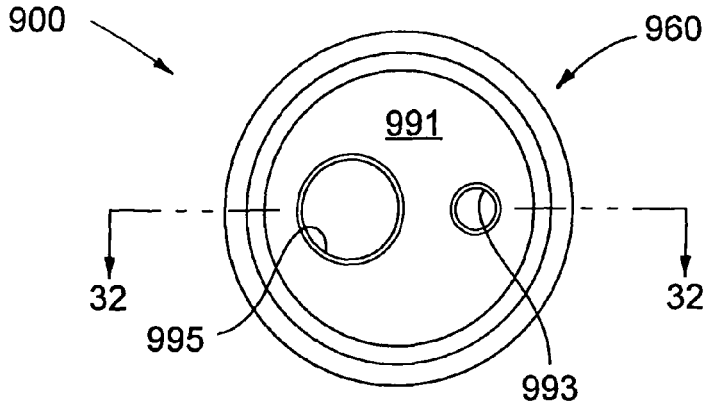
FIG. 31 is a top plan view of the positive pressure liquid transfer and removal system of FIG. 30.
Figure 32:
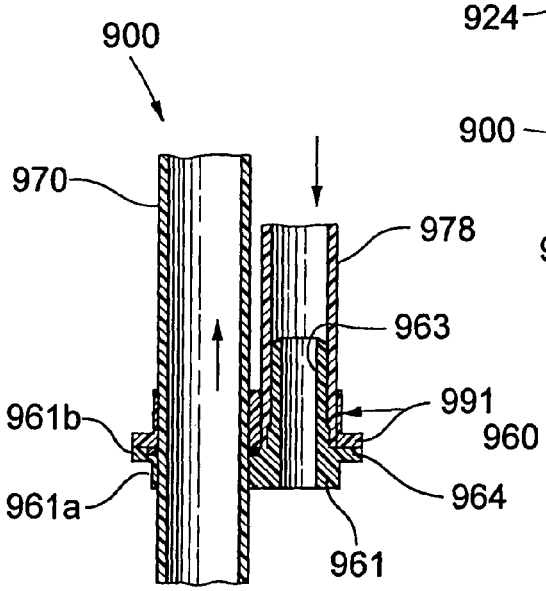
FIG. 32 is a cross-sectional side elevational view taken along section line 32-32 of FIG. 31.
Figure 33:
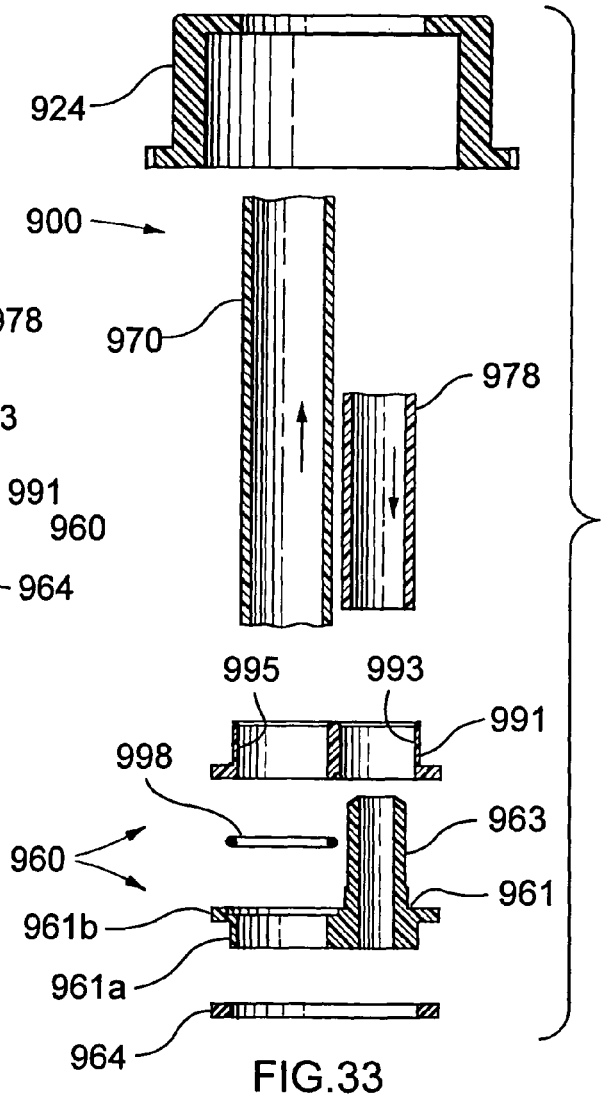
FIG. 33 is an exploded side elevational view of the positive pressure liquid transfer and removal system as shown in FIG. 32.
Figure 34:
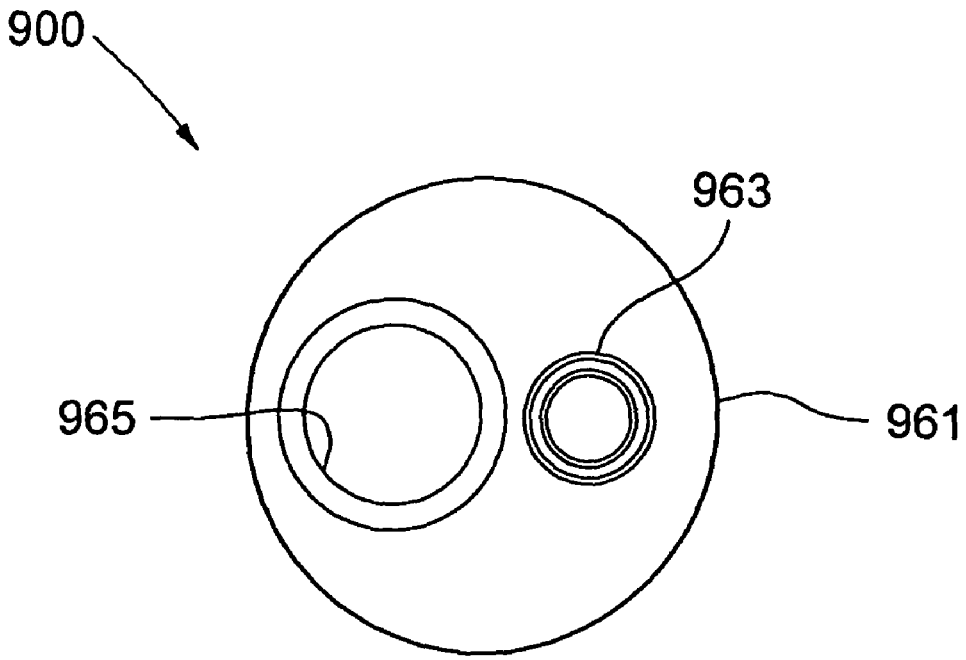
FIG. 34 is a top plan view of the lower fitting of the positive pressure liquid transfer and removal system of FIG. 29.
Figure 35:
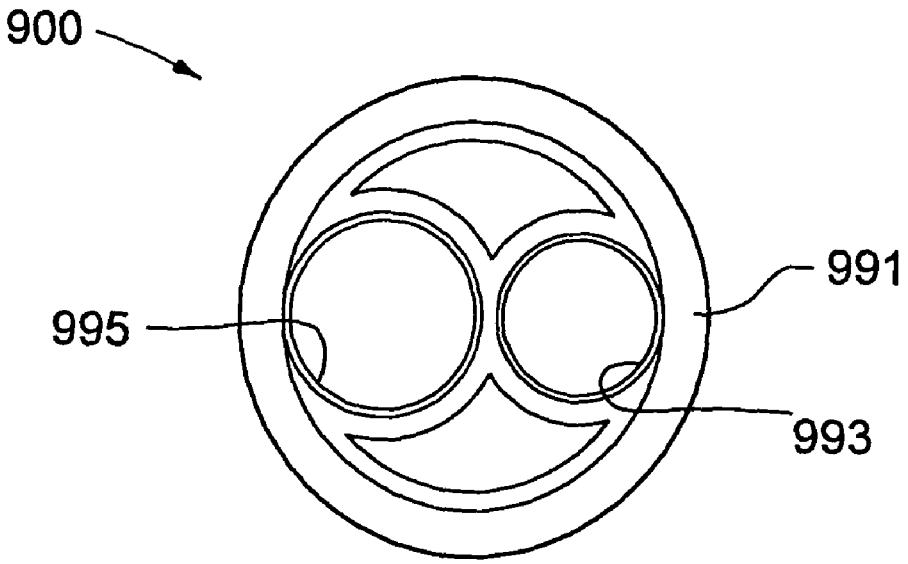
FIG. 35 is a top plan view of the upper fitting of the positive pressure liquid transfer and removal system of FIG. 29.
Figure 36:
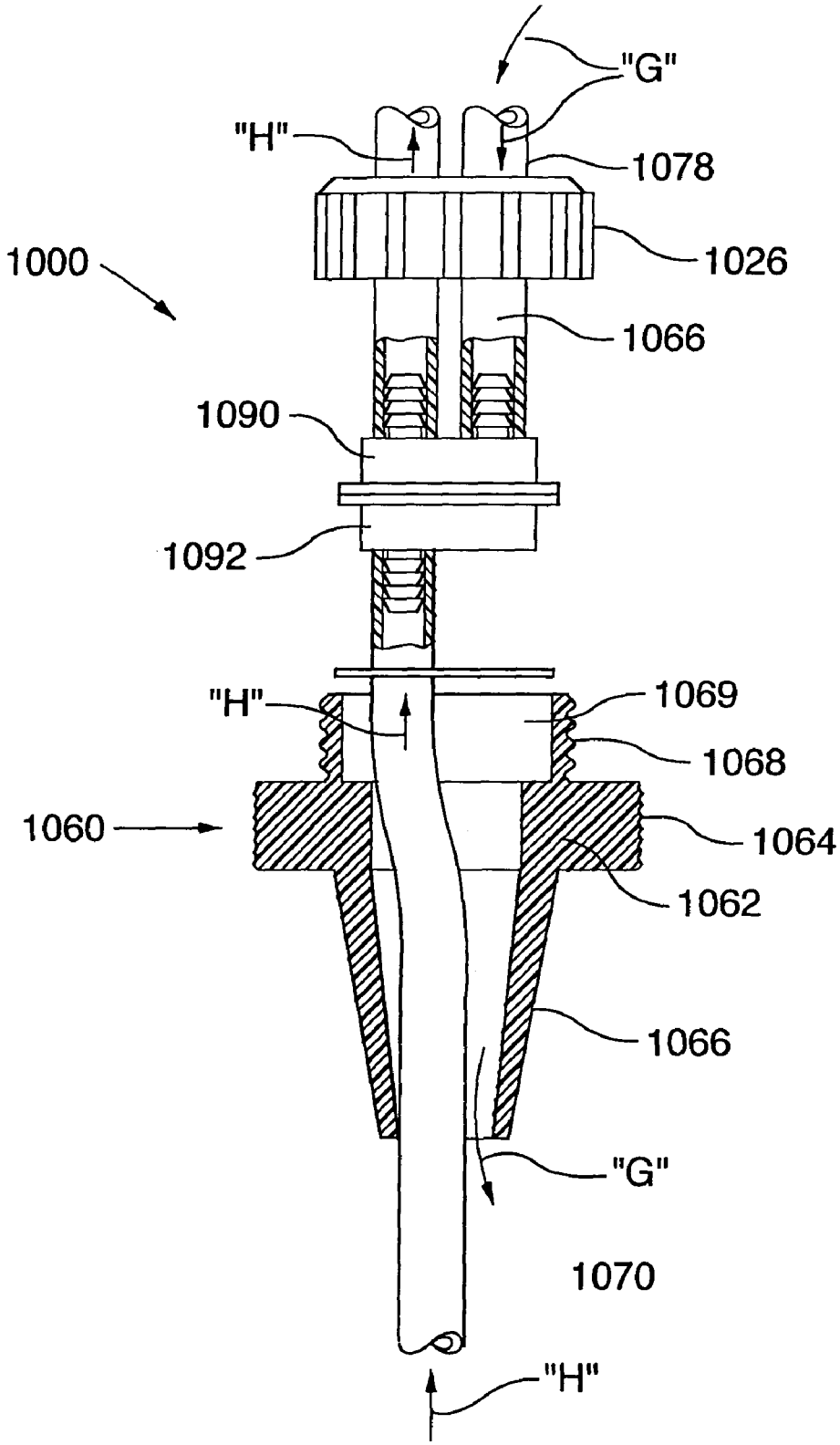
FIG. 36 is a partially cut-away side elevational view of a tenth preferred embodiment of the positive pressure liquid transfer and removal system according to the present invention.

Referring to FIGS. 1 through 36 of the drawings, it will be noted that FIGS. 1 through 13 illustrate a first preferred embodiment of the positive pressure liquid transfer and removal system and method of the present invention, FIGS. 14 through 16 illustrate a second preferred embodiment of the positive pressure liquid transfer and removal system and method of the present invention, FIG. 17 illustrates a third preferred embodiment of the positive pressure liquid transfer and removal system and method of the present invention, FIGS. 18 through 20 illustrate a fourth preferred embodiment of the positive pressure liquid transfer and removal system and method of the present invention, FIG. 21 illustrates a fifth preferred embodiment of the positive pressure liquid transfer and removal system and method of the present invention, FIGS. 22 through 26 illustrate a sixth preferred embodiment of the positive pressure liquid transfer and removal system and method of the present invention, FIG. 27 illustrates a seventh preferred embodiment of the positive pressure liquid transfer and removal system and method of the present invention, FIG. 28 illustrates an eighth preferred embodiment of the positive pressure liquid transfer and removal system and method of the present invention, FIGS. 29 through 35 illustrate a ninth preferred embodiment of the positive pressure liquid transfer and removal system and method of the present invention, and FIG. 36 illustrates a tenth preferred embodiment of the positive pressure liquid transfer and removal system and method of the present invention.

Reference will now be made to FIGS. 1 through 13, which show a first preferred embodiment of the positive pressure liquid transfer and removal system and method, as indicated by the general reference numeral 20, according to the present invention. The positive pressure liquid transfer and removal system 20 is configured for manual operation by a hand and by a foot, and is for pumping liquid from a container, such as a conventional portable fuel container 22, a fuel tank in a vehicle, a water bottle, and so on, to a destination, such as a container, a fuel tank in a vehicle, another conventional portable fuel container, and so on. The container must have an aperture, such as a mouth 24 on the conventional portable fuel container 22, and be substantially sealable such that there can be an air pressure build-up in the container. The increased air pressure is used to essentially push liquid from the container, through a fitting that seals the aperture of the container.

In the first preferred embodiment, as illustrated, the positive pressure liquid transfer and removal system 20 comprises a foot operable pump means in the form of a foot operable pump 30, a liquid delivery hose means, as indicated by the general reference numeral 40, that has a liquid intake section 50, a fitting 60, and a liquid transport hose section 70, and a handheld dispenser unit as indicated by the general reference numeral 80, containing a hand operable valve means operable by one hand, as indicated by the general reference numeral 90, for controlling the flow of liquid through the liquid delivery hose means 40.

The foot operable pump 30 is operable by one foot stepping downwardly on it, while a user's other foot remains on a stable supporting surface, such as the ground. The hand operated valve means 90 is operable by one hand, as is described in greater detail subsequently, for reasons of convenience and safety.

The various elements of the first preferred embodiment positive pressure liquid transfer and removal system 20 and related method, will now be described in greater detail with reference to FIGS. 1 through 13.

The foot operable pump 30 comprises a foot operable air pump 30 operable by one foot and having a hollow rubber hemi-spherical air bladder 32 an outlet nozzle 34 and a plurality of inlet openings 36 surrounding the outlet nozzle 34. The hollow rubber hemi-spherical air bladder 32 is compressed, typically by a person stepping on it with one foot, or is otherwise compressed, to expel air out of the outlet nozzle 34. The hollow rubber hemi-spherical air bladder 32 is resilient so as to suction air into its interior through the plurality of inlet openings 36.

Figure 1:
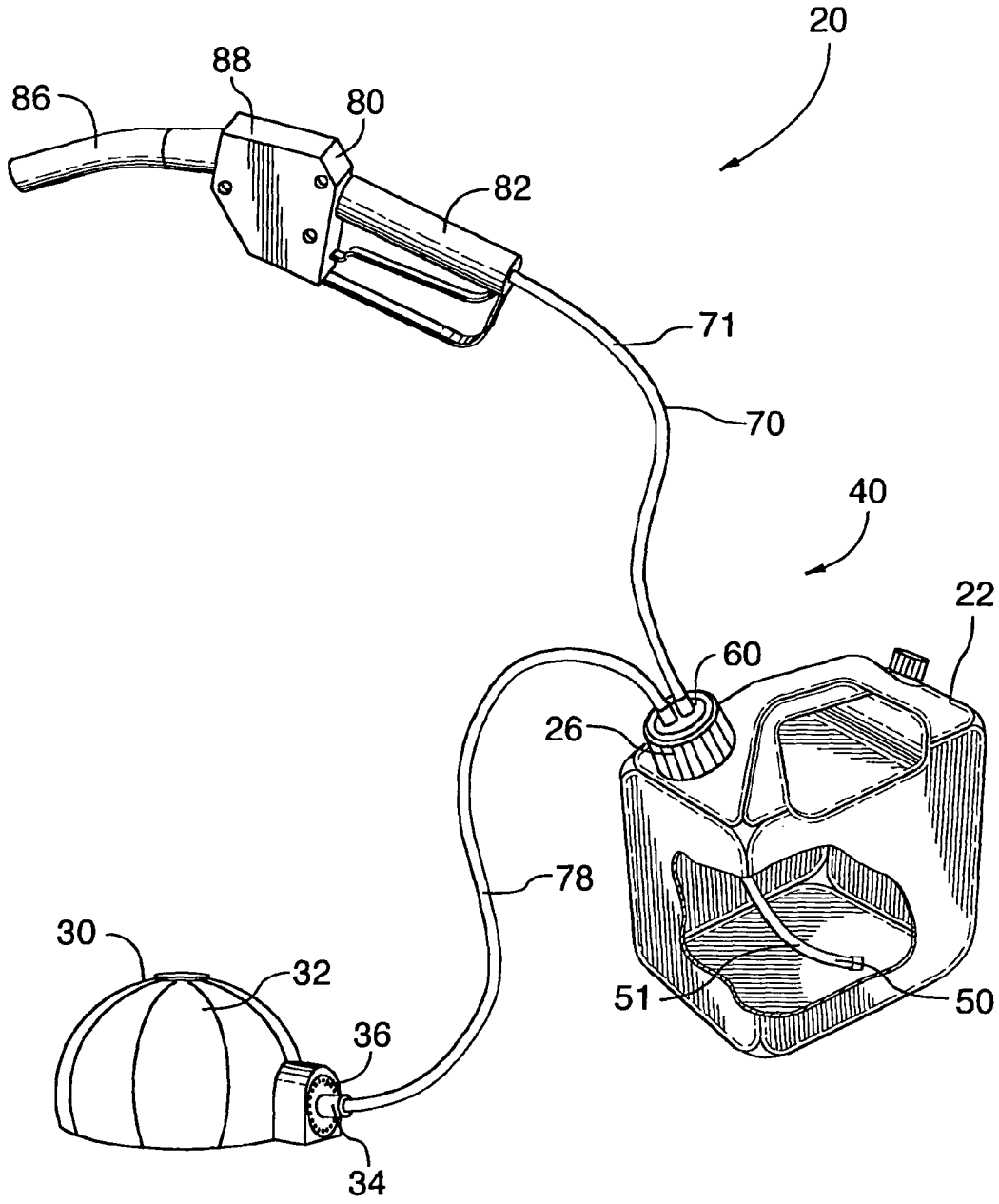
FIG. 1 is a perspective pictorial view of the first preferred embodiment of the positive pressure liquid transfer and removal system according to the present invention, showing the fitting in place in the mouth of a conventional portable fuel container.
Figure 2:
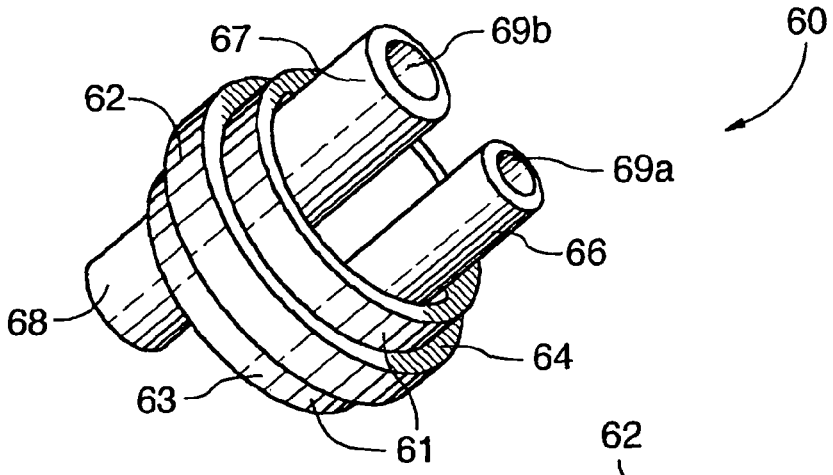
FIG. 2 is an enlarged perspective view of the fuel can fitting of the positive pressure liquid transfer and removal system of FIG. 1, which fuel container fitting is fitted into the mouth of the conventional portable fuel can containing the liquid being pumped.
Figure 4:
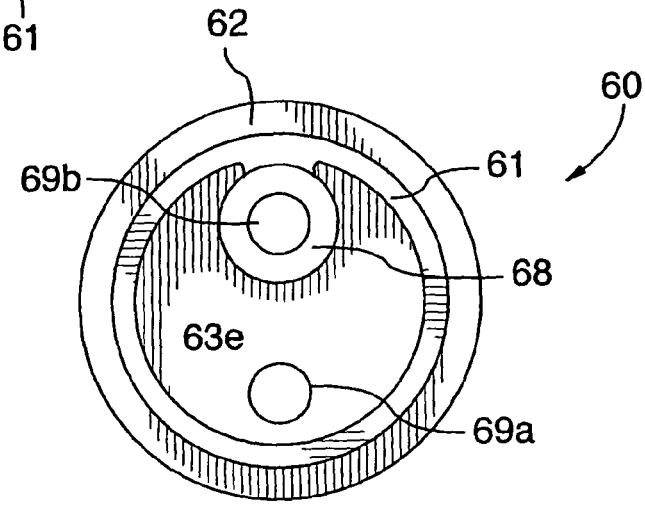
FIG. 4 is an end view of the exterior end of the fuel container fitting of FIG. 2.
Figure 3:
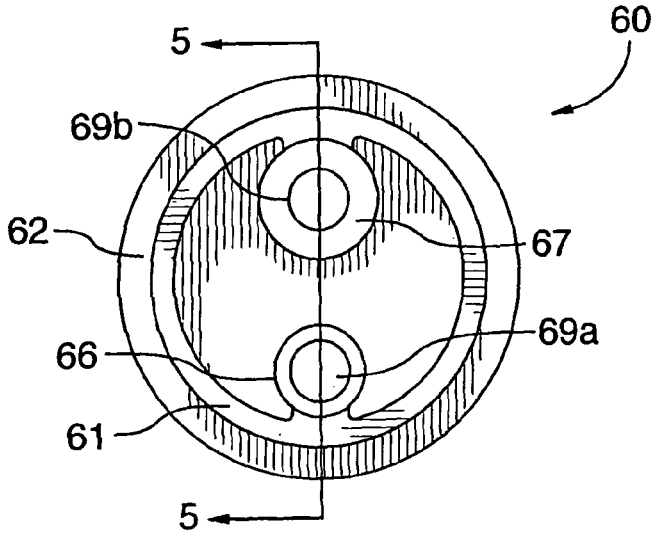
FIG. 3 is an end view of the exterior end of the fuel container fitting of FIG. 2.

The liquid delivery hose means 40, as can be best seen in FIG. 1, is for delivering liquid from a container, such as a the conventional portable fuel container 22, to a destination, such as a fuel tank in a vehicle, another conventional portable fuel container, and so on. The liquid delivery hose means 40 has, in seriatim, the liquid intake section 50, the fitting 60 for engaging the aperture of the convention portable fuel container 22, and the liquid transport hose section 70.

Figure 5:
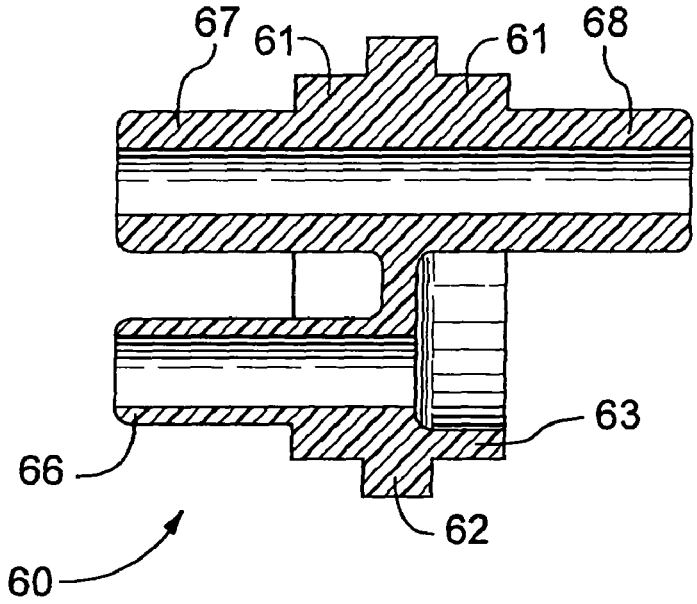
FIG. 5 is a sectional side elevational view of the fuel container fitting of FIG. 2, taken along section line 5-5.
Figure 6:
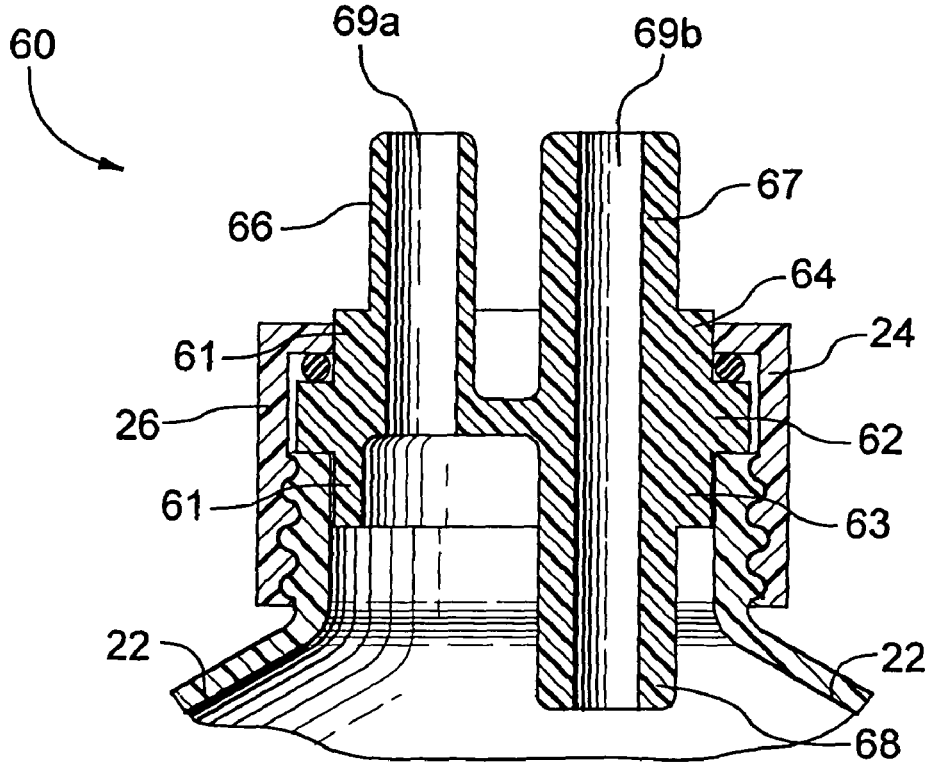
FIG. 6 is a cross-sectional side elevational view of the fuel container fitting of FIG. 2, in place in a conventional portable fuel can.
Figure 7:
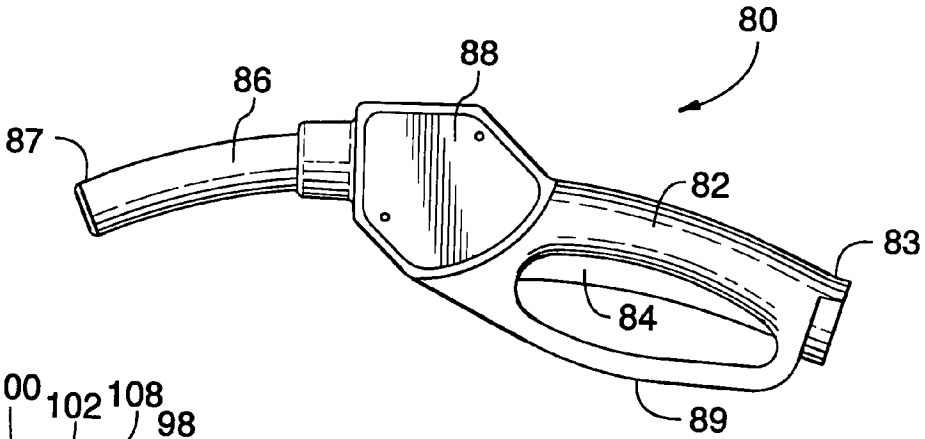
FIG. 7 is a side elevational view of the handheld dispenser unit of the positive pressure liquid transfer and removal system of FIG. 1.

As can be best seen in FIGS. 5 and 6, in the first preferred embodiment, the fitting 60 is a fuel container fitting 60 for fitment onto the mouth 24 of the conventional portable fuel container 22. The fuel container fitting 60 has a cylindrical main body 61 with a generally centrally located annular flange 62 that divides the cylindrical main body 61 longitudinally into an insertable portion 63 and an exterior portion 64. The annular flange 62 is shaped and dimensioned and is of sufficient diameter to preclude the fuel container fitting 60 from passing through the mouth 24 of the conventional portable fuel container 22. The diameter of the insertable portion 63 of the main body is just slightly smaller than the diameter of the mouth 24 of the conventional portable fuel container 22 so as to readily be situatable therein. The diameter of the exterior portion 64 of the main body 61 is just slightly smaller than the interior diameter of the cap 26 of the conventional portable fuel container 22 so as to permit the cap 26 to be threadibly engaged on the threads of the mouth 24 of the conventional portable fuel container 22. The insertable portion 63 of the fuel container fitting 60 has an "O"-ring 65 disposed in abutting relation against the generally centrally located annular flange 62 to ensure that the cap 26 is in sealed relation against the fuel container fitting 60. The fuel container fitting 60 is secured in place on the conventional portable fuel container 22 by the conventional threaded cap 26 of the conventional portable fuel container 22, in the same manner as the gooseneck type fuel delivery spout would be kept in place by the cap 26.

The air inlet nozzle 66 and liquid outlet nozzle 67, both project outwardly from the exterior portion 64 of the fuel container fitting 60. A liquid receiving nozzle 68 projects outwardly from the insertable portion 63 of the fuel container fitting 60. Each of the air inlet nozzle 66, the liquid outlet nozzle 67, and the liquid receiving nozzle 68 is appropriately serrated so as to securely retain hoses connected thereto, as will be described in grater detail subsequently.

The air inlet nozzle 66 is in fluid communication with the end face 63*e* of the insertable portion 63 of the fuel container fitting 60 through a borehole 69*a*. The borehole 69*a* acts as an air ingress passageway through the fuel container filling 60. The liquid outlet nozzle 67 is axially aligned with and is in fluid communication with the liquid receiving nozzle 68 through a common borehole 69*b*. The common borehole 69*b* acts as a liquid egress passageway that connects the liquid intake section 50 and the liquid transport hose section 70 in fluid communication one with the other.

There is also means for connecting the pump means sealed air-delivery relation to the conventional portable fuel container 22 at its mouth 24, thereby permitting delivery of air from the foot operable air pump 30 into the conventional portable fuel container 22 through its mouth 24, so as to thereby affect a positive air pressure in the fuel container 22. In the preferred embodiment as illustrated, the means for connecting the foot operable air pump 30 in sealed air delivering relation to the conventional portable fuel container 22 at its mouth 24 comprises the air supply hose 78 and the air inlet nozzle 66 disposed on the fuel container fitting 60. The air supply hose 78 is connected at its air delivery end 78*a* to the air inlet nozzle 66 so as to be in air delivering relation to the conventional portable fuel container 22 through the air ingress passageway, namely the borehole 96*a*. The air supply hose 78 is also connected at its air receiving end 78*b* to the air outlet nozzle 34 of the foot operable air pump 30, to thereby permit delivery of air from the foot operable air pump 30 into the conventional portable fuel container 22, through its mouth 24. In this manner, the foot operable air pump 30 is connected in sealed air-delivery relation to the conventional portable fuel container 22, thereby permitting a positive air pressure to be effected in the conventional portable fuel container 22.

In the first preferred embodiment, as illustrated, and is as best seen in FIG. 1, the liquid intake section 50 comprises a liquid intake hose section that, in the first preferred embodiment, is an individual liquid intake hose 51 having a liquid inlet end 51*a* and a liquid outlet end 51*b*. A liquid inlet is disposed at the inlet end 51*a*. The liquid intake hose 51 should be of sufficient length to extend to the bottom of a conventional portable fuel container 22, such as a five gallon or a ten gallon conventional portable fuel container. The liquid intake hose 51 is insertable into liquid in the conventional portable fuel container 22 such that the liquid inlet 53 is in liquid receiving relation within the conventional portable fuel container 22. Preferably, a suitable filter 58 is fitted onto the liquid inlet end 51*a* of the liquid intake hose 51, to preclude dirt, debris, and the like, from being pumped into the liquid intake hose 51 and passing through the fitting 60, the liquid transport hose section 70, and the handheld dispenser unit 80, containing the hand operable valve means 90.

The liquid outlet end 51*b* of the liquid intake hose 51 is securely connected in sealed liquid transport relation to the liquid receiving nozzle 68 on the interior end of a fuel container fitting 60, such that the liquid intake hose 51 is in fluid communication with the common borehole 69*b*, which is the liquid egress passageway.

In the first preferred embodiment, as illustrated, and is as best seen in FIG. 1, the liquid transport hose section 70 comprises an individual liquid transport hose 71 having a liquid inlet end 71*a* and a liquid outlet end 71*b*. The liquid transport hose 71 is connected at the liquid inlet end 71*a* in sealed liquid receiving relation to the liquid outlet nozzle 67 of the fitting 60 so as to be in fluid communication with the common borehole 69*b*, which is the liquid egress passageway, thereby permitting liquid to be transported from the conventional portable fuel container 22 to the handheld dispenser unit 80.

In the above described manner, the liquid delivery hose means 40 is connected in sealed liquid-receiving relation to the conventional portable fuel container 22 at its mouth 24 such that the inlet end 51*a* of the liquid intake hose 51 is submerged in liquid in the conventional portable fuel container 22.

Figure 8:
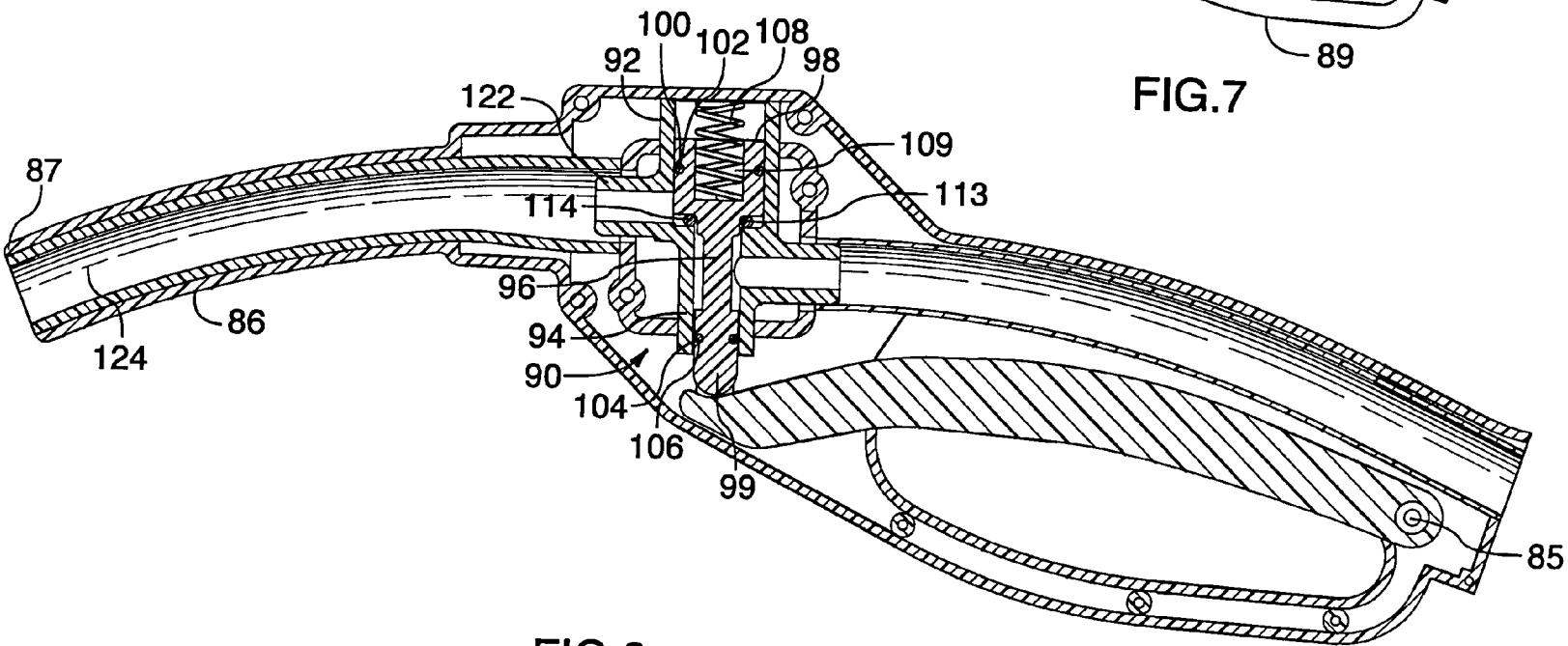
FIG. 8 is a cross-sectional side elevational view of the handheld dispenser unit of FIG. 7, with the valve mechanism in a closed flow-precluding position so as to preclude the flow of liquid through the valve mechanism.
Figure 9:
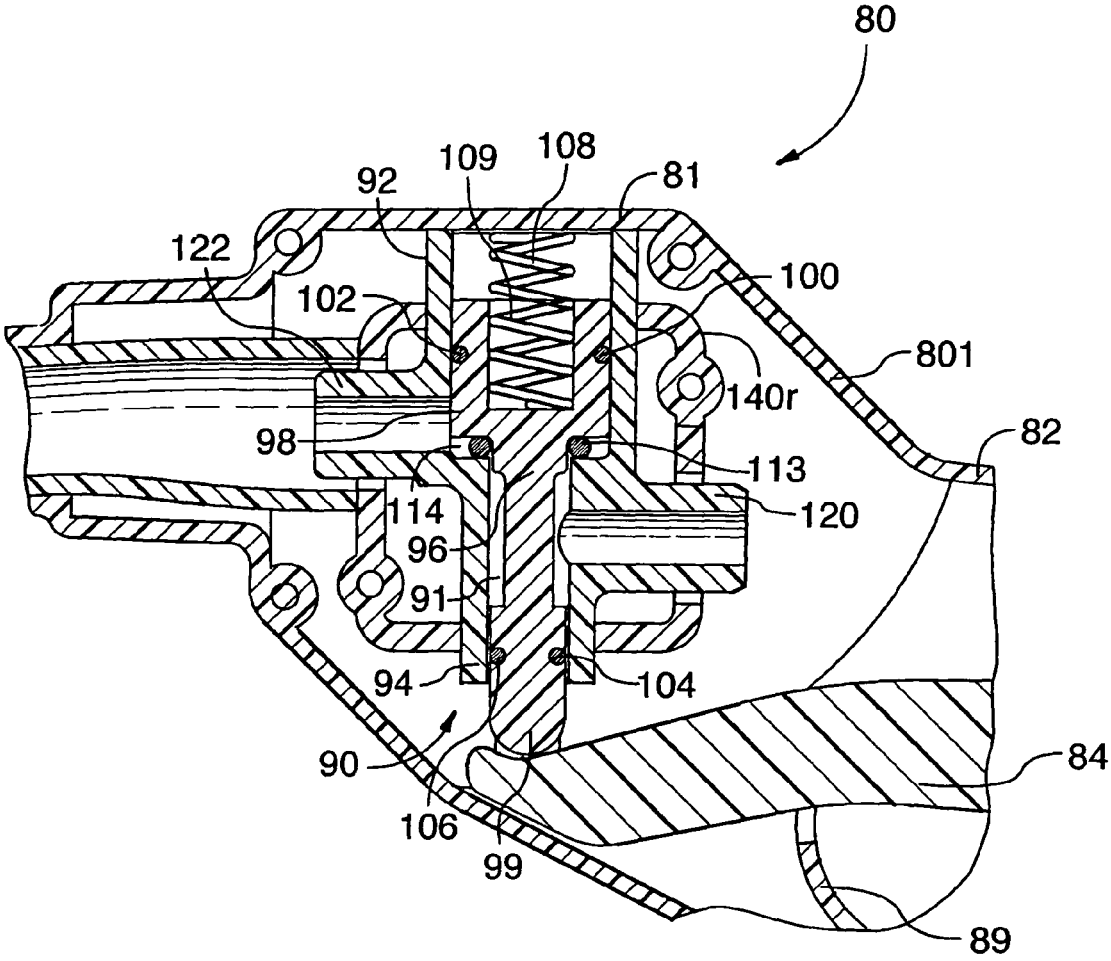
FIG. 9 is an enlarged cross-sectional side elevational view of a portion of the valve mechanism of the handheld dispenser unit of FIG. 8.
Figure 10:
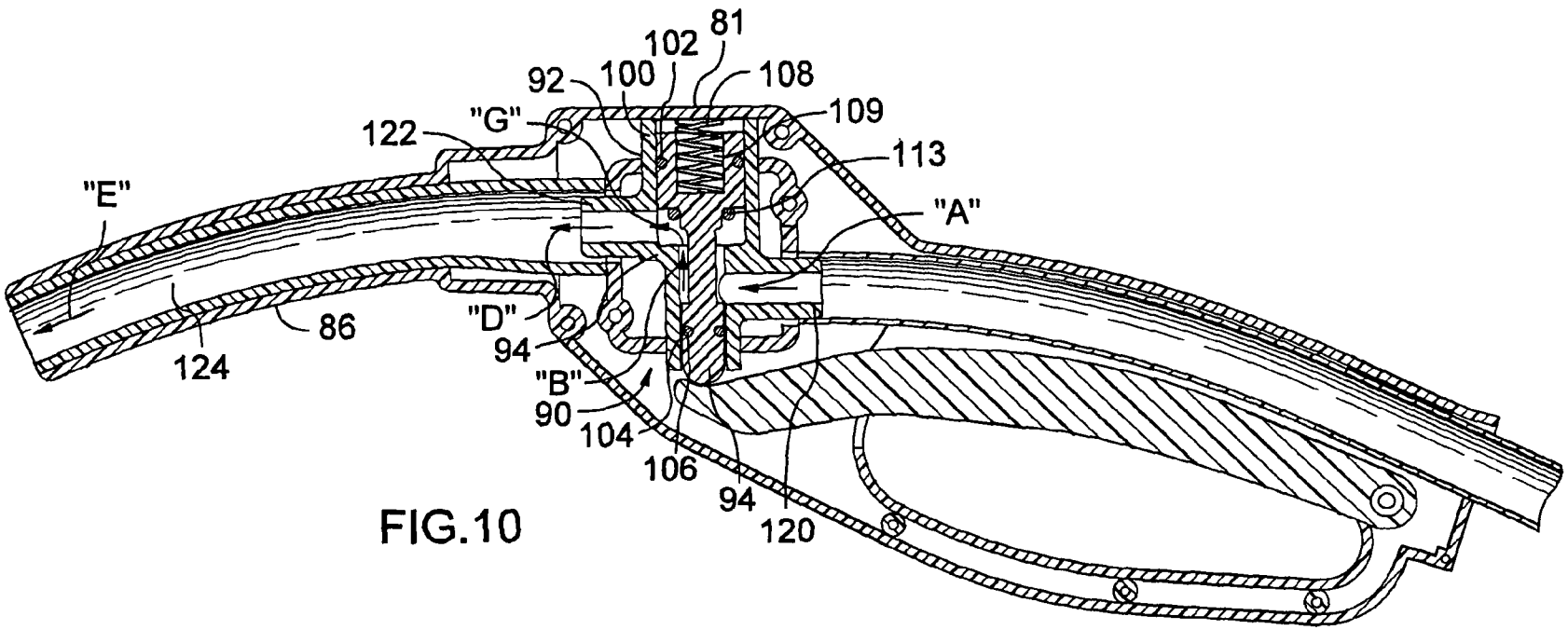
FIG. 10 is a cross-sectional side elevational view of the handheld dispenser unit of FIG. 7, with the valve mechanism in an open flow-permitting position so as to permit the flow of liquid through the valve mechanism.
Figure 11:
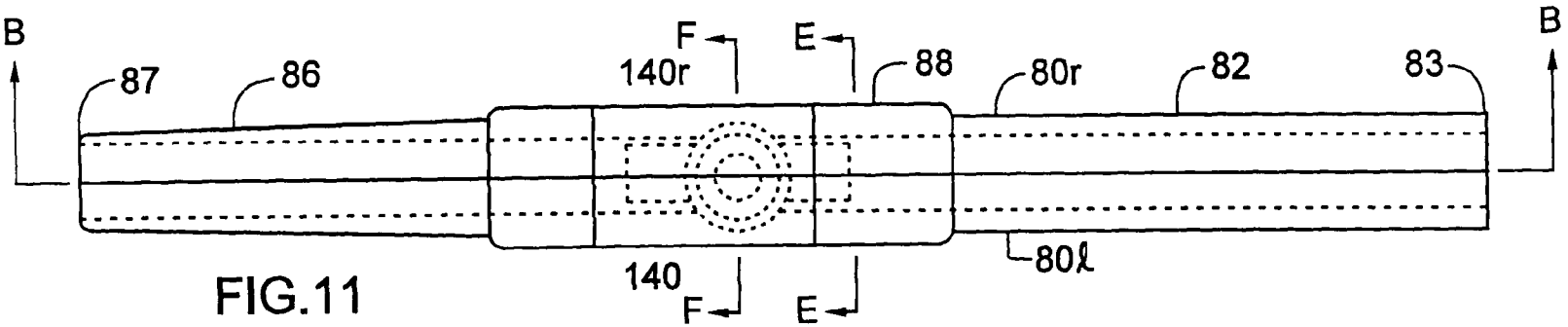
FIG. 11 is a top plan view of the handheld dispenser unit of FIG. 7.
Figure 12:
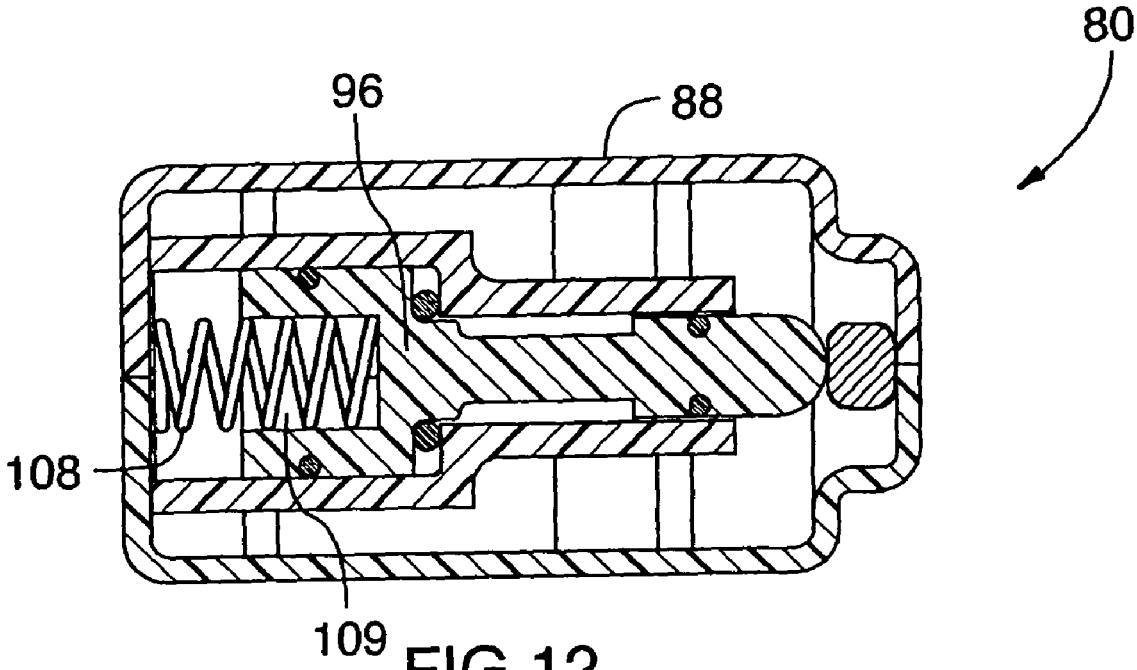
FIG. 12 is a sectional end elevational view of the handheld dispenser unit of FIG. 7, taken along section line 12-12 of FIG. 11.
Figure 13:
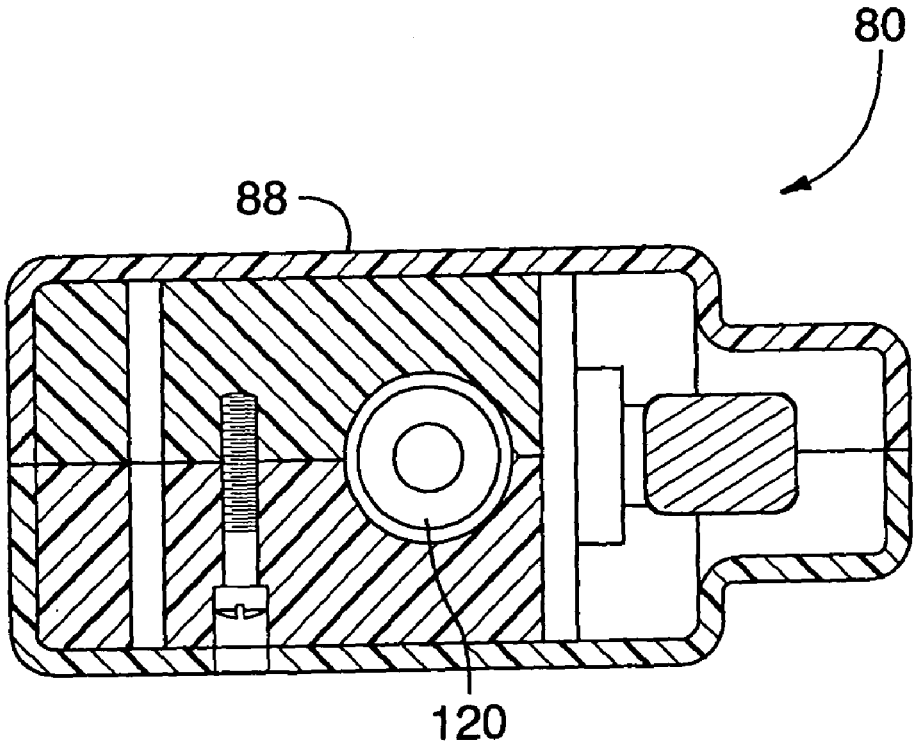
FIG. 13 is a sectional end elevational view of the handheld dispenser unit of FIG. 7, taken along section line 13-13 of FIG. 11.

The handheld dispenser unit 80 comprises a hand grip portion 82 disposed at the inlet end 83 of the handheld dispenser unit 80. A finger operable trigger member 84 is pivotally mounted on the hand grip portion 82 of the handheld dispenser unit 80 by means of a threaded fastener 85, for movement between a liquid flow-precluding position, as is best seen in FIGS. 8 and 9, and a liquid dispensing position, as is best seen in FIG. 10. A curved dispensing spout 86 is disposed at the delivery end 87 of the handheld dispenser unit 80, and is shaped and dimensioned to fit loosely into conventional inlet to a fuel tank on a vehicle, lawn mower, and so on. A central valve housing portion 88 interconnects the hand grip portion 82 and the curved dispensing spout 86 and houses the valve means 90 that is mounted on the liquid delivery hose means 40, for controlling the flow of liquid through the liquid delivery hose means 40. In this manner, the valve means 90 is operated by one hand, specifically by operation of the finger operable trigger member 84, is used to preclude and permit the flow of liquid from the handheld dispenser unit 80, as will be discussed in greater subsequently. A protective handle portion 89 is disposed below the hand grip portion 82 so as to help preclude the finger operable trigger member 84 from being accidentally actuated.

The valve means 90 has a cylindrically shaped main housing 92 located above a cylindrically shaped shaft receiving housing 94 having a smaller diameter than the main housing 92. A valve member 96 has a plunger portion 98 disposed within the main housing 92 and a shaft portion 99 disposed within the shaft receiving housing 94. An "O"-ring 100 seated in a co-operating annular channel 102 in the plunger portion 98 and an "O"-ring 104 seated in a co-operating annular channel 106 in the shaft portion 99 preclude liquid from escaping from the interior 91 of the valve mechanism 90. The valve member 96 is axially slidable between a flow-precluding position, as is best seen in FIGS. 8 and 9 and corresponding to the flow-precluding position of the trigger member 84, and a flow permitting position, as best seen in FIG. 10 and corresponding to the flow-permitting position of the trigger member 84, and is biased to its flow precluding position by a compressed coil spring 108 retained within a spring pocket 109 and acting between the plunger portion 98 of the valve member 96 and the outer wall 81 of the handheld dispenser unit 80. The shaft portion 99 has a narrow throat portion 110 that permits passage of liquid through the valve mechanism 90 when the valve member 96 is in its flow-permitting position, as indicated by arrow "B" in FIG. 10. An "O"-ring 112 mounted on the valve member 96 immediately below the plunger portion 98 contacts a flat seating surface 114 in sealed relation thereto when the valve member 96 is in its flow precluding position, so as to fully preclude the flow of liquid through the valve mechanism 90.

A liquid inlet nozzle 120 is located rearwardly of the shaft receiving housing 94 and is in fluid communication with the interior of the shaft receiving housing 94. The outlet end 71*b* of the flexible liquid transport hose 71 is connected to the liquid inlet nozzle 120 to permit delivery of liquid into the valve mechanism 90. In the above described manner, the hand operable valve means 90 is operatively mounted on the liquid delivery hose means 40.

A liquid delivery nozzle 122 is located forwardly of the main housing 92 and is in fluid communication with the interior of the main housing 92. A liquid dispensing hose 124 is connected to the liquid delivery nozzle 122 to permit delivery of liquid from the valve mechanism 90 and subsequent dispensing of the liquid from the curved dispensing spout 86.

The valve mechanism 90 is captured between a left half 80*l* and a right half 80*r* of the handheld dispenser unit 80, and more specifically is retained within the central valve housing portion 88 between a left square-shaped mount 120*l* located on the left half 80*l* of the handheld dispenser unit 80 a right square-shaped mount 120*r* located on the right half 80*r* of the handheld dispenser unit 80, so as to face each other in aligned relation. The left and right square-shaped mounts 120*l*,120*r* have suitable apertures to receive the liquid inlet nozzle 120, the liquid delivery nozzle 122, the main housing 92 of the valve, and the shaft receiving housing 94 of the valve mechanism 90.

Use of the positive pressure liquid transfer and removal system 20 will now be described. In use, the foot operable air pump 30 is operated by a person's foot, or in other words, is stepped on, to produce pressurized air flow therefrom through its outlet nozzle 34. This pressurized air passes through the air supply hose 78 and through the fuel container fitting 60, via the borehole 69*a* in the air inlet nozzle 66, and into the conventional portable fuel container 22. The air within the conventional portable fuel container 22 becomes pressurized, thus facing air pressure on the surface of the fuel in the conventional portable fuel container 22, thereby causing gasoline, diesel fuel, or whatever fuel is contained therein, to flow from the conventional portable fuel container 22 through the liquid intake hose 51 and through the common borehole 69*b* in the liquid receiving nozzle 68 and the liquid outlet nozzle 67. The fuel then travels through the flexible liquid transport hose 70 and into the valve mechanism 90. The hand operable valve mechanism 90 is operated by one hand, and more specifically through operation of the trigger member 84, between a closed flow-precluding position as is best seen in FIG. 8, and an open flow-permitting position, as is best seen in FIG. 10. As can be best seen in FIG. 10, with the valve mechanism 90 in its flow-permitting position, fuel enters the liquid inlet nozzle 120 of the valve mechanism 90 as indicated by arrow "A", passes by the narrow throat portion of the plunger portion 98, as indicated by arrow "B", and enters the central chamber of the valve mechanism 90 as indicated by arrow "C", and then exits the valve mechanism 90 via the liquid delivery nozzle 122, as indicated by arrow "D". The fuel is then dispensed from the curved dispensing spout 86 through the liquid dispensing hose within the delivery nozzle and secured to the liquid delivery nozzle 122 of the valve mechanism 90, as indicated by arrow "E". If the valve mechanism 90 is in its flow-precluding position, as can be best seen in FIGS. 8 and 9, flow of the fuel is precluded.

As is described above, the foot operated air pump 30 is operable by foot and the hand operable valve mechanism 90 is operable by hand, to cause liquid to flow from the conventional portable fuel container 22, through the liquid delivery hose means 40, to a destination.

As can be appreciated by one skilled in the art, the volume of liquid being pumped is directly proportional to the air pressure within the conventional portable fuel container 22. Accordingly, it is possible to keep a substantial rate of liquid flow during the entire pumping operation, which is not possible with prior art siphoning systems.

Reference will now be made to FIGS. 14 through 16, which show a second preferred embodiment of the positive pressure liquid transfer and removal system and method, as indicated by the general reference numeral 200, according to the present invention. The second preferred embodiment positive pressure liquid transfer and removal system 200 is similar to the first preferred embodiment positive pressure liquid transfer and removal system 20, except that the container 222 has a first aperture, namely the mouth 224 of the container 222, and has a second aperture, namely the vent opening 225, that is typically covered by a cap (not shown). The fitting 260 this placed in the mouth 224 of the container 222 has only a single borehole 269*b*. The borehole 269*b* acts as a liquid egress passageway that connects the liquid intake hose 251 and the liquid transport hose 271 in fluid communication one with the other, as can be best seen in FIG. 15. FIG. 16 shows a secondary fuel container cap having an air inlet nozzle 266 thereon and a borehole 269*a* that acts as an air ingress passageway. The air supply hose 278 is connected at its air delivery end to the air inlet nozzle 266. The air inlet nozzle 266 thereby acts as the means for connecting the pump means 230 in sealed air-delivery relation to the container 222 at the second aperture 225. This arrangement permits delivery of air from the pump means 230 into the container 222 through the second aperture namely the vent opening 225, so as to thereby effect a positive air pressure in the container 222. The positive air pressure in the container 230 causes liquid in the container 222 to flow from the container 222, through the liquid delivery hose means 240.

Reference will now be made to FIG. 17, which shows a third preferred embodiment of the positive pressure liquid transfer and removal system and method, as indicated by the general reference numeral 300, according to the present invention. The third preferred embodiment positive pressure liquid transfer and removal system 300 is similar to the first preferred embodiment positive pressure liquid transfer and removal system 20, except that the fitting 360 comprises a tapered main body 362 that is suitable for fitment into the mouth 324 of a conventional water bottle 322, or even the mouth of a portable fuel container (not shown). Preferably, the tapered outer wall 361 of the fitting 360 has a coarse thread to permit the fitting 360 to be properly retained within a container, when the container is air pressurized.

An alternative type of handheld dispenser unit 380 is shown in FIG. 14. The handheld dispenser unit 380 has a "C"-shaped handle portion and a threaded "T"-handled rod that together act as a "C"-clamp that is used to clamp the handheld dispenser unit 380 in place, such as on a counter, or the like. The valve mechanism (not specifically shown) within the handheld dispenser unit 380 works in the same manner as the valve mechanism 90 of the first preferred embodiment positive pressure liquid transfer and removal system 20.

Also, a bellows type air pump 330 is shown, which works in the same manner as the foot operable air pump 30 of the first preferred embodiment positive pressure liquid transfer and removal system 20.

Reference will now be made to FIGS. 18 through 20, which show a fourth preferred embodiment of the positive pressure liquid transfer and removal system and method, as indicated by the general reference numeral 400, according to the present invention. The fourth preferred embodiment positive pressure liquid transfer and removal system 400 is similar to the first preferred embodiment positive pressure liquid transfer and removal system 20, except that the fitting 460 is tapered. The fitting 460 also has a serrated air inlet nozzle 466 that receives the air supply hose 478 securely thereon. A first borehole 469*a* extends through the main body 462 and the air inlet nozzle 466, to permit air to be pumped through the fitting 460 and into a container, such as a fuel tank in a vehicle. A second larger borehole 469*b* receives a plastic tube therethrough, which plastic tube is the liquid intake hose 451 and the liquid transfer hose 471.

Additionally, there is a guide member 402 having an upper cylindrical portion 404 and a lower tapered portion 405 with air holes 406 therein. A throughpassage 408 extends from the top end 402*t* of the guide member 402 to the bottom end of the guide member 402. The liquid transfer hose 471 extends through the passage of the guide member 402 and through the second borehole 469*b* of the fitting 460.

In use, the guide member 402 is engaged on the liquid intake hose section 451 and remains in place thereon as the opening 403 at the bottom end 402*b* of the tapered portion 404 of the guide member 402 is suitably sized to permit the guide member 402 to frictionally engage the liquid intake hose section 451. The liquid intake hose section 451 and the guide member 402 are inserted into the inlet 410 of the filler pipe 412 of a fuel tank of a vehicle to the appropriate depth. The fitting 460 is then slid along the liquid intake hose section 451 of the plastic tube toward the inlet 410 of the filler pipe 412, and is partially inserted into the filler pipe 412 so as to be received in sealed relation therein, thus sealing off the only opening to the fuel tank. Air is then pumped from the air pump (not shown) through the air supply 478, through the fitting 460 and then through the throughpassage 408 of the guide member 402 and out through the air holes 406 in the lower tapered portion 404 of the guide member 402 and along the filler pipe 412 into the fuel tank. Fuel is thereby forced up the liquid intake hose 451, to its destination.

Reference will now be made to FIG. 21, which shows part of a fifth preferred embodiment of the positive pressure liquid transfer and removal system and method, as indicated by the general reference numeral 500, according to the present invention. The fifth preferred embodiment positive pressure liquid transfer and removal system 500 is similar to the fourth preferred embodiment positive pressure liquid transfer and removal system 400, except that the serrated air inlet nozzle 566 is removable and replaceable by means of a threaded portion 567 at its lower end, which threadibly engages a cooperating threaded portion 569*t* disposed at the upper end of the first borehole 569*a*. Such a removable and replaceable air inlet nozzle 566 permits a suitable diameter air inlet nozzle 566 to be used, depending on the diameter of the air supply hose 578 that is available, or desired.

Reference will now be made to FIGS. 22 through 26, which show a sixth preferred embodiment of the positive pressure liquid transfer and removal system and method, as indicated by the general reference numeral 600, according to the present invention. The sixth preferred embodiment positive pressure liquid transfer and removal system 600 is similar to the first preferred embodiment positive pressure liquid transfer and removal system 20, except that there is also an additional adapter mechanism 602 that is specifically designed for insertion into the inlet 604 of the filler pipe 606 a fuel tank of a vehicle. The adapter mechanism 602 has a hollow cylindrical main body 608 having a diameter suitable to fit into the inlet 604 of the filler pipe 606 of the fuel tank of a vehicle. At the top end 608*t* of the hollow cylindrical main body 608 is a male threaded portion 609 that has the same size and pitch of thread as does a conventional portable fuel tank. A swivel nozzle assembly 610 is attached to the bottom end 608*b* of the hollow cylindrical main body 608 by means of a swivel joint 612, wherein an enlarged top portion 613 of the swivel nozzle assembly 610 is received in pivoting relation within an annular recess 614 having a defining inner wall 615 with a partial circular cross section. The swivel nozzle assembly 610 has a plurality of vent holes 616 therein and also has a main aperture 617 at its bottom end 617*b*.

The purpose of the cylindrical main body 608 and the swivel nozzle assembly 610 is to push open the hinged shutter at the inlet 604 of a filler pipe 606 of the fuel tank of a vehicle, and also to preclude the liquid intake hose 651 from being cut or otherwise damaged by any sharp edges on or around the hinged shutter. Further, the swivel nozzle assembly 610 permits the adapter mechanism 602 to accommodate various shapes of filler pipes by pivoting as indicated by arrows "F" in FIG. 26.

A sealing cap 618 is engaged in snug yet rotatable and slidable relation on the hollow cylindrical main body 608. Preferably, there is about 0.002 inches clearance between the outer surface of the cylindrical main body 608 and the inner surface of the sealing cap 618, so as to permit rotational and sliding movement of the sealing cap 618 with respect to the cylindrical main body 608, and also provide a substantial seal so as to preclude the passage of air therebetween. In this manner, excessive air pressure within the fuel tank of the vehicle will force the cylindrical main body 608 outwardly until the narrower cross-section swivel nozzle assembly 610 is at the sealing cap 618, thereby creating a clearance between the sealing cap 618 and both of the cylindrical main body 608 and swivel nozzle assembly 610, to thereby permit the excess air pressure to be relieved. The sealing cap 618 has a knurled top portion 618*a* and a threaded lower portion 618*b* having threads the same size and pitch as a fuel tank cap that threadibly engages the cooperatingly threaded outer end of the inlet 604 of a filler pipe 606 of the fuel tank of a vehicle. An "O"-ring 619 is disposed immediately below the top knurled portion of the sealing cap 618 so as to engage against the end surface of the inlet 604 of a filler pipe 606 of the fuel tank of a vehicle in sealed relation therewith.

The fitting 660, which is the same as the fitting 60 in the first preferred embodiment, is inserted into the top end 608*t* of the hollow cylindrical main body 608. The generally centrally located annular flange 662 that divides the main body 661 of the fitting 660 into an insertable portion 663 and an exterior portion 664, ensures that the fitting does not fall entirely into the interior of the hollow cylindrical main body 608. An "O"-ring is disposed around the insertable portion 663 and immediately under the annular flange 662 so as to engage the top end surface of the cylindrical main body when the fitting 660 is in place.

A liquid intake hose 651 is connected at its liquid outlet end 651*b* to the liquid receiving nozzle 668 and extends downwardly through the hollow interior of the cylindrical main body 608 and through the hollow interior of the swivel nozzle assembly 610 and exits the swivel nozzle assembly 610 through its bottom aperture. The liquid intake hose 651 is of a suitable length to extend to the bottom of a fuel tank in a vehicle.

The air supply hose 678 is connected in the same manner as in the first preferred embodiment to the air inlet nozzle 666 of the fitting 660. Similarly, the liquid transport hose 671 is connected in similar manner to that described in the first preferred embodiment to the liquid outlet nozzle 667.

In use, the fitting 660 is engaged into the open top end of the cylindrical main body of the adapter mechanism 602 and is secured in place by the cap 624 that threadibly engages the threads at the top end of the cylindrical main body.

Figure 24:
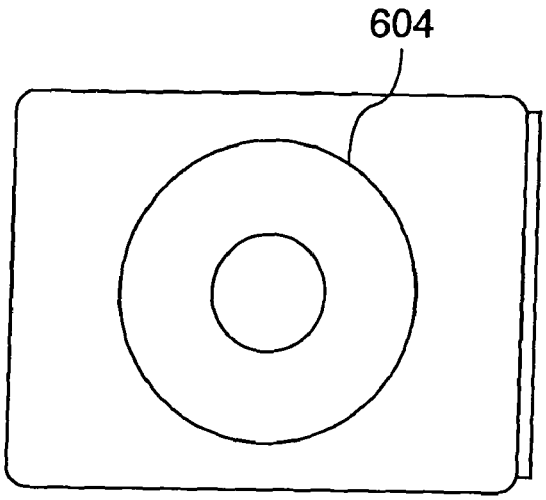
FIG. 24 is a plan view of the inlet of the fuel tank of a vehicle, with the hinged shutter in a closed position.
Figure 25:
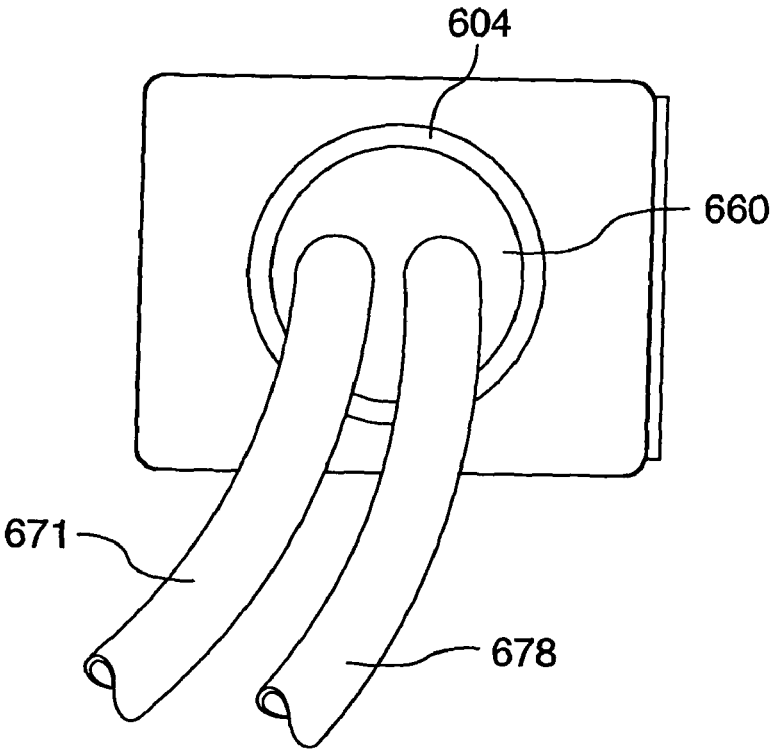
FIG. 25 is a view similar to FIG. 21, but with the hinged shutter in an open position and the positive pressure liquid transfer and removal system of FIG. 19 inserted into the inlet.
Figure 26:
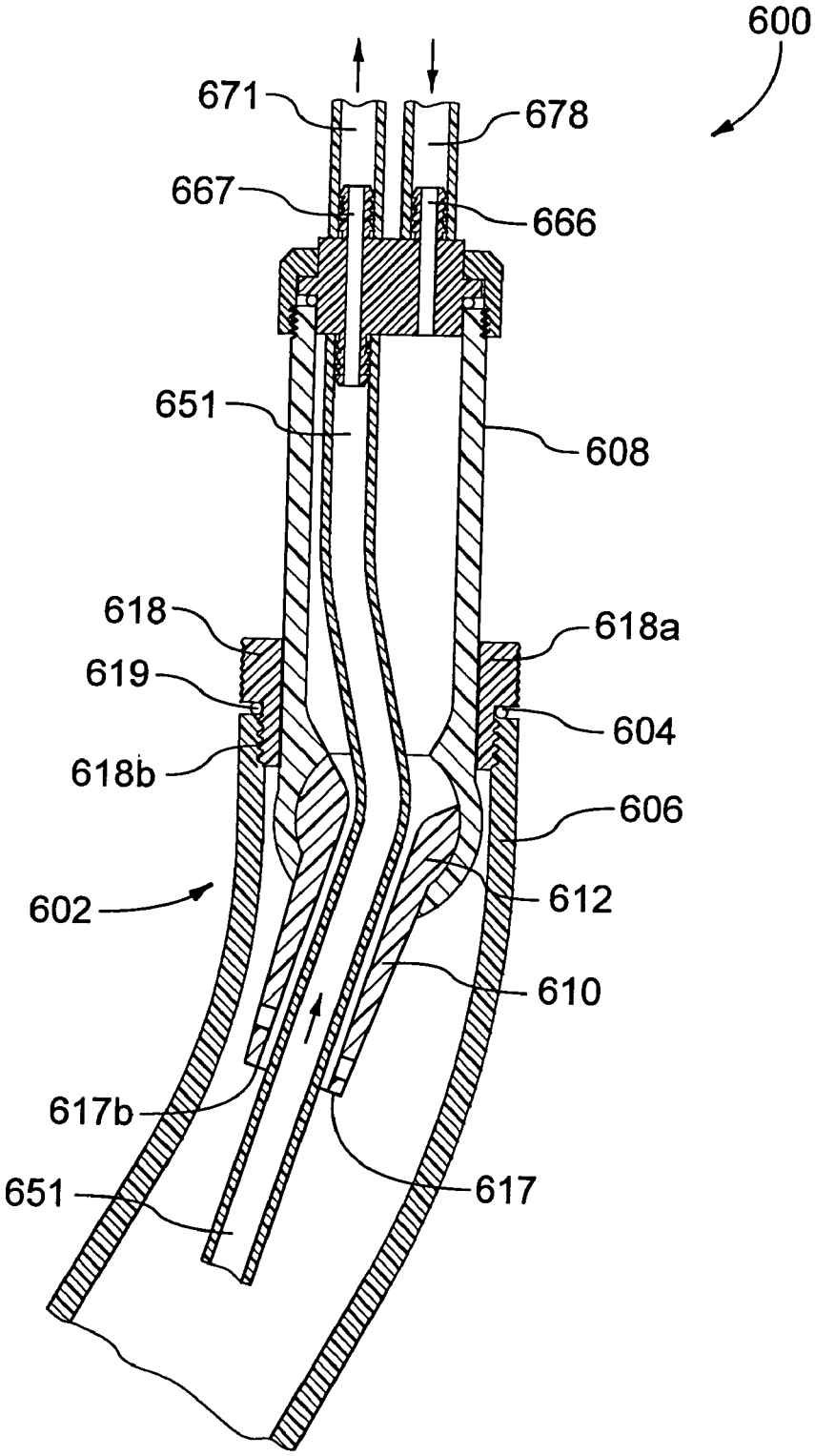
FIG. 26 is a cross-sectional side elevational view of the positive pressure liquid transfer and removal system shown in FIG. 22 inserted into the inlet of the filler pipe of a fuel tank of a vehicle, taken along section line 26-26 of FIG. 25.

In use, the inlet 604, as shown in FIG. 24, of the filler pipe 606 of the fuel tank of the vehicle is located and the bottom end 608*b* of the swivel nozzle assembly 610 pushes open the hinged shutter and is pushed into the interior of filler pipe 606, until the adapter mechanism 602 stops travelling or until the threaded top end of the cylindrical main body nears the inlet 604 of the filler pipe 606. The sealing cap 618 is then threadibly engaged into the cooperating thread at the inlet 604 of the filler pipe 606.

Once the adapter mechanism 602 is in place, the pump 630 is pumped so as to provide air flow through the air supply hose 678 and through the fitting 660 and into the hollow interior of the cylindrical main body and the swivel nozzle assembly 610. The air exits the swivel nozzle assembly 610 through the various openings in it and also through the end aperture, so as to thereby affect a positive air pressure in the fuel tank of the vehicle. The positive air pressure in the fuel tank of the vehicle causes fuel to flow from the fuel tank, into the liquid intake hose 651, through the fitting 660, and into the liquid transport hose 671.

Cap 624, such as from a conventional portable fuel container (not shown), fits over the fitting 660 and engages the thread at the top end of the cylindrical main body so as to secure the fitting in place.

Reference will now be made to FIG. 27, which shows part of a seventh preferred embodiment of the positive pressure liquid transfer and removal system and method, as indicated by the general reference numeral 700, according to the present invention. The seventh preferred embodiment positive pressure liquid transfer and removal system 700 is similar to the sixth preferred embodiment positive pressure liquid transfer and removal system 600 except for the inclusion of an additional body tube turning ring 707 on the cylindrical main body tube 708. The tube turning ring 707 permits easier turning of the cylindrical main body 708 and precludes the adapter mechanism 702 from falling into the filler pipe 706.

Reference will now be made to FIG. 28, which shows a portion of an eighth preferred embodiment of the positive pressure liquid transfer and removal system and method, as indicated by the general reference numeral 800, according to the present invention. The eighth preferred embodiment positive pressure liquid transfer and removal system 800 is similar to the first preferred embodiment positive pressure liquid transfer and removal system 20, except that the liquid intake section 850 of the liquid delivery hose means 840 comprises an extension 851 of the fitting 860. In other words, the fitting 860 and liquid intake section 850 are all one intricately formed plastic molded unit.

Reference will now be made to FIGS. 29 through 35, which show a portion of a ninth preferred embodiment of the positive pressure liquid transfer and removal system and method, as indicated by the general reference numeral 900, according to the present invention. The ninth preferred embodiment positive pressure liquid transfer and removal system 900 discloses a fitting assembly 960 for use in the positive pressure liquid transfer and removal system 900. The fitting assembly 960 is similar to the fitting 360 in the first preferred embodiment of the positive pressure liquid transfer and removal system and method, except that the fitting assembly 960 a lower fitting 961 and an upper fitting 991.

The lower fitting 961 has a main body 962 shaped and dimensioned to engage in sealed relation the mouth of a conventional portable fuel container. More specifically, the lower fitting 961 has an insertable portion 961*a* shaped and dimensioned to be inserted into the mouth of a conventional portable fuel container, and an upper portion 961*b*, that is preferably circular and is shaped and dimensioned to engage in sealed relation the mouth of a portable fuel container. An "O"-ring 964 is disposed around the periphery of the insertable portion 961*a* to engage the mouth of a conventional portable fuel container. An air inlet nozzle 963 extends upwardly from the lower fitting 961. There is a liquid delivery hose opening 965 in the lower fitting 961. The liquid delivery hose opening 965 permits passage of a liquid delivery hose 970 therethrough, such that the free end of the liquid delivery hose 970 is ultimately inserted into a conventional portable fuel container. The air inlet nozzle 963 has an air supply hose 978 secured in sealed air delivery relation thereto.

The upper fitting 991 has a main body 992 shaped and dimensioned to fit within the cap 924 of a conventional portable fuel container, and has an air supply hose opening 993 and a liquid delivery hose opening 995. The liquid delivery hose 970 passes through the liquid delivery hose opening 995 in addition to passing through the liquid delivery hose opening 965 in the lower fitting 961. The liquid delivery hose 970 can readily be longitudinally positioned within the two liquid delivery hose openings 965,995 to allow a suitable length of hose to reach to the bottom of the fuel container that it is in. An "O"-ring 998 is disposed in frictional engagement on the liquid delivery hose 970, and is trapped between the lower fitting 961 and the upper fitting 991, so as to retain the liquid delivery hose 970 in place in the fitting assembly 960, and preclude liquid delivery hose 970 from accidentally being pulled up or even being pulled out.

The air supply hose 978 passes through the air supply hose opening 993 and is secured in sealed air delivery relation onto the air inlet nozzle 963. The diameter of the air supply hose opening 993 is such that it retains the air supply hose 978 securely on the air inlet nozzle 963. The top of the air inlet nozzle 963 is chamfered so as to readily receive the air supply hose 978 thereon.

The cap 924 for a conventional portable fuel container receives the air supply hose 978 and the liquid delivery hose 970 through its top opening and threadibly engages onto the mouth of a conventional portable fuel container. In use, air is pumped into the portable conventional fuel container, as indicated by arrows "F", so as to cause fuel to flow from the conventional portable fuel container, through the liquid delivery hose 970, as indicated by arrows "G", and to a destination.

Reference will now be made to FIG. 36, which shows a portion of a tenth preferred embodiment of the positive pressure liquid transfer and removal system and method, as indicated by the general reference numeral 1000, according to the present invention. The tenth preferred embodiment positive pressure liquid transfer and removal system 1000 discloses a fitting 1060 for use in the positive pressure liquid transfer and removal system 1000, with the fitting 1060 being similar to the fitting 360 in the third preferred embodiment of the positive pressure liquid transfer and removal system and method, except that the fitting 1060 is shaped and dimensioned for fitment at the inlet of a conventional filler pipe of a vehicle.

The fitting 1060 comprises a main body 1062 having an annular flange 1064 shaped and dimensioned to engage in sealed relation the inlet of a conventional filler pipe of a vehicle. The annular flange 1064 must therefore be larger in diameter than the inlet of a conventional filler pipe of a vehicle.

There is also a tapered portion 1066 that projects outwardly from the annular flange 1064. The tapered portion 1066 is shaped and dimensioned to engage in sealed wedged relation into the inlet of a conventional filler pipe of a vehicle, and may be any suitable shape, with on alternative shape being shown in dashed lining.

A threaded inlet nozzle 1068 projects outwardly from the annular flange 1064, in an opposite direction to the tapered portion 1066. The thread on the threaded inlet nozzle 1068 is essentially the same as the thread on the mouth of a conventional portable fuel container. In this manner, the cap 1026 from a conventional portable fuel container can be used to securely engage the threaded inlet nozzle 1068.

A throughpassage 1069 extends through the annular flange 1064, the tapered portion 1066, and the threaded inlet nozzle 1068. The throughpassage 1069 permits the passage of a liquid delivery hose 1070 therethrough, such that the free end of the liquid delivery hose 1070 is inserted into the fuel tank of a vehicle through its filler pipe (not shown).

In use, the tapered portion 1066 of the fitting 1060 is inserted into the inlet of a conventional filler pipe of a vehicle, so as to engage in sealed wedged relation into the inlet of a conventional filler pipe of a vehicle. The fitting assembly 1090, which is the same as the fitting assembly described in the ninth preferred embodiment, is placed over the threaded inlet nozzle 1068. The liquid delivery hose 1070 passes through the liquid delivery hose opening (not shown) in the upper fitting 1090 and also passes through the liquid delivery hose opening (not shown) in the lower fitting 1092. The air supply hose 1078 is secured to the air inlet nozzle 1066 of the lower fitting 1092. The fitting assembly is retained in placed on the threaded inlet nozzle 1068 by the cap 1026. Air is pumped into the fuel tank of a vehicle, as indicated by arrows "G", so as to cause fuel to flow from the fuel tank, through the liquid delivery hose 1070, as indicated by arrows "H", and to a destination.

It must also be understood that in addition to transferring fuel from a conventional portable fuel container into a gasoline tank, or transferring fuel from a gasoline tank into a conventional portable fuel container or any other type of container or receptacle, the present invention can be used to directly transfer fuel from the fuel tank of a source vehicle to the fuel tank of a destination vehicle. Such vehicles might include motorcycles, snowmobiles, boats, recreational vehicles, hovercraft, swamp boats, four-wheelers, and so on. In use, an adapter, of the type showing in FIG. 36, or similar, is inserted into the open end of the filler pipe of the fuel tank of the source vehicle. The dispensing spout of the handheld dispenser unit is inserted into the open end of the filler pipe of the fuel tank of the destination vehicle. The positive pressure liquid transfer and removal system is then used to pressurize the fuel tank of the source vehicle, to thereby transfer fuel in the same manner as described with reference to FIG. 36.

The adapter is shaped and dimensioned appropriately for the size and type of filler pipe on the destination vehicle, and could vary in diameter and taper, to suit the application. Accordingly, fuel can be transferred from one vehicle to another without using an intermediate receptacle, thus precluding contamination of the fuel, and making the transfer of fuel quite easy. In this manner, it is now possible with the present invention to easily and safely transfer fuel in difficult situations, such as between two vehicles in the wilderness, where one vehicle has run out of fuel. For instance, the destination vehicle might be a snowmobile that has run out of fuel, and the source vehicle might be another snowmobile, a four-wheeler, and so on.

It is also contemplated in the present invention that in the liquid delivery hose means, the liquid intake section and the liquid transport hose section could comprise a single section of hose passing through a borehole in the fitting. Also, it is contemplated that this single piece of hose could be disposed between the fitting and the mouth of the container, as long as a substantially sealed relation between the hose, the mouth of the container, and the fitting, could be realized.

It is also contemplated that the valve mechanism could be omitted; however, the liquid flow from a container would be controlled essentially from the air pressure within the container as caused by the air pump.

As can be understood from the above description and from the accompanying drawings, the present invention provides a positive pressure liquid transfer and removal system and method for pumping liquids from one container to another, wherein the pumping mechanism and the destination can be at a the same elevation or at a higher elevation than the source, for pumping fuel from one container to another, and for pumping fuel from a fuel tank in a vehicle to a destination, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the positive pressure liquid transfer and removal system and method of the present invention without departing from the spirit and scope of the accompanying claims.

I claim:

1. A positive pressure liquid transfer and removal system for pumping liquid from a container to a destination, said container having an aperture opening to the interior thereof, comprising:

fitting means for engaging said aperture in said container in sealed relation thereto, said fitting means including ingress and egress ports in flow communication with each other;

liquid delivery hose means releasably connectable at one end thereof to said egress port of said fitting means;

liquid intake hose means releasably connectable to said ingress port of said fitting means and insertable into liquid within said container;

foot operable pump means;

pressure hose means for connecting said pump means to said container in sealed relation thereto for pressurizing said container; and hand operable valve means comprising:

a housing with a hand operable actuating lever pivotally connected at one end thereof to said housing;

a valve element within said housing, said valve element including liquid inlet and outlet ports, said liquid inlet port communicating with the other end of said liquid delivery hose means, said outlet port communicating with an outlet of said valve means;

a valve member within said valve element, said valve member being displaceable between a first position normally blocking liquid flow from said inlet port to said outlet port and a second position permitting liquid flow from said inlet port to said outlet port, said valve member including an end surface engageable with the opposite end of said actuating lever; and compression spring means within said valve element and normally biasing said valve member to said first position; and wherein said valve member further includes a shaft portion with said end surface at one end thereof, and a plunger portion at an end opposite said one end, said plunger portion being cup-shaped and of a diameter greater than that of said shaft portion, said cup-shaped plunger portion receiving one end of said compression spring means, the opposite end of said compression spring means being engageable with said housing;

whereby foot operation of said pump means will pressurize said container, permitting liquid to flow under pressure from said container, through said liquid intake hose, said fitting means, and said liquid delivery hose means, to and through said valve means as controlled by said actuating lever and said valve member for delivery to said destination.

2. The system of claim 1 wherein said fitting means includes an air ingress port releasably connectable to said pressure hose means and an air egress port for communicating pressurized air from said pump means to the interior of said container.

3. The system of claim 1, wherein said fitting means comprises a cylindrical main body receivable within the aperture of said container, and an annular flange on the exterior of said main body, said flange being receivable on an annular edge of said aperture.

4. The system of claim 1 wherein said fitting means comprises a tapered main body receivable within said aperture of said container.

5. The system of claim 1 wherein said valve element includes a shaft receiving portion and a plunger receiving portion, said inlet port communicating with said shaft receiving potion and said outlet port communicating with said plunger receiving portion.

6. The system of claim 5 including means sealing said shaft portion within said shaft receiving portion and said plunger portion within said plunger receiving portion.

7. The system of claim 6 wherein said sealing means includes a first a-ring seal member surrounding said shaft portion below said inlet port, a second O-ring seal member on said plunger portion above said outlet port, and a third O-ring seal member in a seat portion of said plunger portion engageable with a seat portion of said valve element.

8. The system of claim 1 wherein said shaft portion includes a section of reduced diameter between said end surface and said plunger portion for permitting the flow of liquid there past from said inlet port to said outlet port when said valve member is in said second position.

9. A method of pumping liquid from a container to a destination, said container having at least one aperture therein opening to the interior thereof, said method comprising the steps of:

connecting a foot operable pump means to an air pressure hose and connecting said air pressure hose to said container;

connecting one end of a liquid intake hose to an ingress port of a fitting member and a liquid delivery hose to an egress port of said fitting member, said ingress and egress ports being in liquid flow communication with each other;

connecting said fitting member to said at least one aperture of said container in sealed relation thereto, with said liquid intake hose being inserted into liquid residing within said container;

providing said liquid delivery hose at the other end thereof with hand operable valve means, said valve means including a valve actuating lever hinged at one end thereof to a housing of said valve means and a valve member within said housing and in engagement with the opposite end of said actuating lever, compression spring means within said valve means normally biasing said valve member to a closed condition to prevent the flow of liquid there past, said valve member further including a shaft portion with said end surface at one end thereof, and a plunger portion at an end opposite said one end, said plunger portion being cup-shaped and of a diameter greater than that of said shaft portion, said cup-shaped plunger portion receiving one end of said compression spring means, the opposite end of said compression spring means being enqaqeable with said housing, and permitting the flow of liquid there past only upon operation of said actuating lever;

operating said pump means by an operator's foot so as to pump air into said container and to thereby pressurize said container; and operating said actuating lever of said valve means to permit the flow of liquid from said container through said intake hose, said fitting member, said delivery hose, and said valve means to transfer liquid from said container to said destination.

10. The method of claim 9 wherein said fitting member includes an air inlet port, and said air pressure hose is connected to said air inlet port.

* * * * *